US007003820B1

(12) United States Patent
Iura et al.

(10) Patent No.: US 7,003,820 B1
(45) Date of Patent: Feb. 28, 2006

(54) SUPPORTIVE DEVICE FOR HANDICAPPED PEOPLE

(75) Inventors: Tadashi Iura, Onsen-gun (JP); Yoshiyuki Tsukamura, Onsen-gun (JP); Keiji Yamamoto, Onsen-gun (JP)

(73) Assignee: Iura Co., Ltd., Onsen-Gun (JP)

( * ) Notice: Subject to any disclaimer, the term of this patent is extended or adjusted under 35 U.S.C. 154(b) by 110 days.

(21) Appl. No.: 09/786,110

(22) PCT Filed: Jun. 29, 2000

(86) PCT No.: PCT/JP00/04382

§ 371 (c)(1),
(2), (4) Date: Jul. 24, 2001

(87) PCT Pub. No.: WO01/01916

PCT Pub. Date: Jan. 11, 2001

(30) Foreign Application Priority Data

Jul. 2, 1999 (JP) ..... 11/189667
Oct. 5, 1999 (JP) ..... 11/284917

(51) Int. Cl.
*A61G 7/10* (2006.01)

(52) U.S. Cl. ..... 5/83.1; 5/86.1; 5/654; 135/67

(58) Field of Classification Search ..... 135/67; 5/86.1, 83.1, 654, 655.3; 280/79.3, 650, 280/657, 79.2, 47.38
See application file for complete search history.

(56) References Cited

U.S. PATENT DOCUMENTS 2,439,163 A * 4/1948 Farmer ..... 5/86.1

(Continued)

FOREIGN PATENT DOCUMENTS

| | | |
|---|---|---|
| GB | 2289259 A * | 11/1995 |
| JP | 61-59734 | 12/1986 |
| JP | 1-195857 | 8/1989 |

(Continued)

*Primary Examiner*—Lanna Mai
(74) *Attorney, Agent, or Firm*—Armstrong, Kratz, Quintos, Hanson & Brooks, LLP.

(57) ABSTRACT

A moving device (1) capable of being operated easily and safely to move a person between various types of beds and chairs by supporting the femoral region and backbone of a person to be moved instead of by suspending the person to be moved by a belt or supporting the axillas and knees of the person, comprising a body frame (4) having a pair of right and left front wheels (2) and rear wheels (3) and having an open rear side, a column (14) erected on the body frame, a pair of right and left side seat parts (32) provided on a pair of right and left side arms (31) fixed to the column, a handrail frame body (46) fixed to the column and having an open rear side, a backbone supporting part (48) disposed at the rear of the seat parts, and a lifting mechanism capable of lifting the seat parts vertically, wherein the arms are formed in a crank-shape and connected pivotally to the column through longitudinal shafts positioned at the front of the knees of the person to be moved, and the seat parts are rotated eccentrically from the outside upper side to the inside lower side so as to insert the seat parts into the lower side of the femoral region while bypassing the knee parts of the person to be moved.

5 Claims, 21 Drawing Sheets

U.S. PATENT DOCUMENTS

| | | | | | |
|---|---|---|---|---|---|
| 2,854,673 | A | * | 10/1958 | Ramsey | 5/86.1 |
| 3,479,087 | A | * | 11/1969 | Burke | 297/339 |
| 3,623,169 | A | * | 11/1971 | James | 5/87.1 |
| 3,790,974 | A | * | 2/1974 | Johansson | 5/83.1 |
| 4,704,749 | A | * | 11/1987 | Aubert | 5/87.1 |
| 4,796,948 | A | * | 1/1989 | Paul et al. | 297/284.1 |

FOREIGN PATENT DOCUMENTS

| | | |
|---|---|---|
| JP | 3-218755 | 9/1991 |
| JP | 4-49965 | 2/1992 |
| JP | 8-243123 | 9/1996 |
| JP | 10-234793 | 9/1998 |
| JP | 11-128275 | 5/1999 |

* cited by examiner

SUPPORTIVE DEVICE FOR HANDICAPPED PEOPLE

FIELD OF THE INVENTION

The present invention relates to a supportive device for helping handicapped people including the invalid who cannot look after themselves because of illness, old age, or injury (hereinafter, referred to as 'patient' or 'patients'), and more particularly to such a supportive device which easily and safely helps patients shift from one structure such as a bed to other such as a supportive wheeled chair (hereinafter 'supportive chair'), a toilet, a shower chair, and a sofa, and vice versa, wherein they can continue to stay on the original structure such as a bed and are not required to stand up therefrom.

BACKGROUND ART

This type of supportive device is known, but a major disadvantage is the uncomfortable feelings felt by the patient and the toil and time experienced by helpers when he or she has to be suspended by a belt or the like. To solve this problem, various solutions are proposed; one example is disclosed in Japanese Patent Laid-Open Application 1-195857 where a pillar is slantingly and rotatably erected on a disk, the pillar having a receiver plate. Another expedient disclosed in Japanese Patent Laid-Open Application 3-218755 teaches that a wheeled base is provided with a pillar, and a column projecting from the pillar, the column being capable of inclining. A body holder is provided in the top of the column.

These two known devices employ a pedal for operating the pillar and column but in operating them the patient feels unstable because of frequent unexpected movements. In addition, it is difficult to control the patient's weight when he or she is shifted one structure to other. The patients sometimes refuse to be shifted because of a strong aversion.

Especially when the helpers are powerless such as women or aged people, the known supportive devices are difficult to operate. The patient has to lean his or her upper body against the receiving plate or the body holder but in this position it is difficult to change their angle of inclination, height, and position. This is very inconvenient.

The present invention is directed to solve the problems pointed out above, and is to provide a supportive device for helping handicapped people shift from one structure such as a bed or a chair to another in which they are only supported in their thighs and back but without being hung or suspended by a belt or the like or being supported in their underarms and knees. No special skill is required.

Another object of the present invention is to provide a supportive device which can be easily and readily operated by women and aged people with no special skill.

SUMMARY OF THE INVENTION

According to one aspect of the present invention, the supportive device includes a chassis having an open rear end, provided with a pair of front wheels and a pair of rear wheels, a pillar erected on the chassis, a pair of arms provided in the pillar, a pair of thigh supports provided in the arms, a handrail whose rear end is open, a back upholstery, and a lifting device for raising and lowering the thigh supports, wherein the arms are eccentrically rotated in accordance with the rotation of shafts axially extending in front of the patient's knees, in the course of the rotation of the arms the thigh supports being inserted under the patient's thighs.

The supportive device is preferably constructed to be capable of inclining, and can be provided with a displacing device provided in the arms whereby the thigh supports are spaced at an adequate interval in accordance with the patient's size.

The displacing device includes a pair of brackets provided in the pillar, a double bearing unit in which a first bearing having an axial hole and a second bearing having a traverse hole are intersected, a shaft having a axial groove, the shaft being provided in the base portion of each of the arms, wherein the axis of each arm is inserted into the second bearing, the double bearing unit being secured in the grooves, wherein a space is produced at a point where the shafts are mutually intersected, the arms being rotatably from its upper position to its lower position, and when the arms are raised upward, the respective thigh supports are horizontally rotated so as to secure an adequate a space interval therebetween.

Preferably, a bag filled with air or gas or liquid is placed behind the thigh supports, the bag being elastically expanded behind the thigh supports when the lowering thigh supports come into contact with a target structure such as a bed, thereby avoiding the risk that the patients are subjected to strong shock and be pinched in their thighs.

According to another aspect of the present invention, the supportive device, as shown in FIG. 17, includes a chassis whose rear end is open, a pillar erected on the chassis, a pair of arms provided in the pillar through a rotary bearing so as to allow the arms to rotate from their upper position to their lower position, a pair of thigh supports provided in the arms, a handrail having an open rear end being provided above the thigh supports, an engaging means provided midway the handrail, a back upholstery, and a lifting device for raising and lowering the thigh supports and the handrail, and wherein the rotary bearing is made as a rotary boss which includes a shaft vertically provided in the pillar and a cylinder axially provided in the pillar, and the arms being rotatably connected to the rotary boss, thereby ensuring that regardless of the position of the arms upward or downward, the thigh supports are maintained rotatable and the space interval therebetween is adjustable.

Preferably, the supportive device is additionally provided with a bearing having a stopper at the front end of the thigh supports, an engager provided integral with the arms thereby to support the thigh supports, wherein the stopper is kept contact with the engager so as to allow the thigh supports to rotate in a predetermined range with respect to the arms.

It is also preferred that the rotary bearing is inclined rearward, so that the patient can shift smoothly with his or her knees keeping out of collision or contact with the rotary bearing.

In order to enable the arms to operate readily, the supportive device is provided with an automatic locking device for holding the arms 106 at a desired upper position.

It is also preferred that a pair of front wheels are provided on the undersurface of a footrest, so that the patients are protected from their feet and fingers being pinched.

In order to ensure a ready attachment and removal of the back upholstery the engager is provided inside the handrail.

The back upholstery can be provided with a back portion made of such a solid and resilient material that the back upholstery can be inserted between the patient and a structure like a supportive chair, and an engaging portion to be engaged by the engager integral with the arm.

Preferably, the back upholstery has a plurality of engaging spots to be selected for engagement with the engager.

The back upholstery can be provided with a three-dimensional back portion having a curved surface.

It is desired that to prevent slipping-off trouble, the back upholstery is provided with a belt.

According to a further aspect of the present invention, the lower framework is provided with an expander, and the lifting device is provided inside a sliding framework vertically slidable along a framework secured to the chassis, and a lever of the lifting device is provided with a mark toward the sliding framework, thereby ensuring that the height of the thigh supports is adjusted by reference to the lever and the mark.

According to the supportive device illustrated in FIGS. 1 to 16, a patient can enjoy various advantages; for example, when he or she shifts from a bed to a supportive chair or from a supportive chair to a toilet, with a helper's aid in the following procedure:

(a) When a patient stays on a bed, the first thing to do is to let him or her sit on the edge of the bed. If the patient stays on a supportive chair or a toilet, let him or her continue to stay there;

(b) The back upholstery and the thigh supports are rotated upward until the rear end of the supportive device is open toward the patient, and the supportive device is moved until it is ready for accommodation;

(c) The supportive device is moved until the thigh supports are positioned alongside the patient's thighs. Some structure like a supportive chair has a frame on each side which seems likely to put an obstacle in the way of the supportive device, but the thigh supports are horizontally rotatable and the space interval therebetween are adjustable, thereby ensuring that the thigh supports are readily inserted between the frame and the patient's thighs;

(d) The lifting device of the thigh supports is operated to adjust a height of the thigh supports, and causes the thigh supports to rotate from their upper position to their lower position and insert into a triangular space formed between the patient's thighs and the bed along the patient's thighs;

(e) The back upholstery is rotated along the patient's back to support his or her back;

(f) The lifting device of the thigh supports is operated to hold the patient up from the bed or supportive chair, as the case may be. At this stage, the thigh supports are inclined so that they are inclined to conform to the patient's thighs and absorb his or her weight. The patient will be relieved of stress and feel comfortable on the supportive device. Likewise, the back upholstery can be inclined so that it conforms to the contour of the patient's back;

(g) The patient is shifted to the target structure, and the lifting device is operated to let the patient sit there. Originally the patient is in danger of his or her thighs being pinched between the thigh supports and the structure but the fluid-filled bag is elastically deformed or expanded rearward when the thigh supports come into contact with the structure so that the patient's thighs are safely raised;

(h) Subsequently, the thigh supports are rotated upward, and the back upholstery is rotated outward from the patient's back so that the thigh supports are opened rearward thereby to allow the patient to shift to the target structure.

(i) The thigh supports are spaced at a given interval, and are only applied to the patient's thighs in which they are open toward the patient's buttocks, so that the patient can use a toilet with ease after shifting there.

DETAILED DESCRIPTION OF PREFERRED EMBODIMENTS

Figure 1:
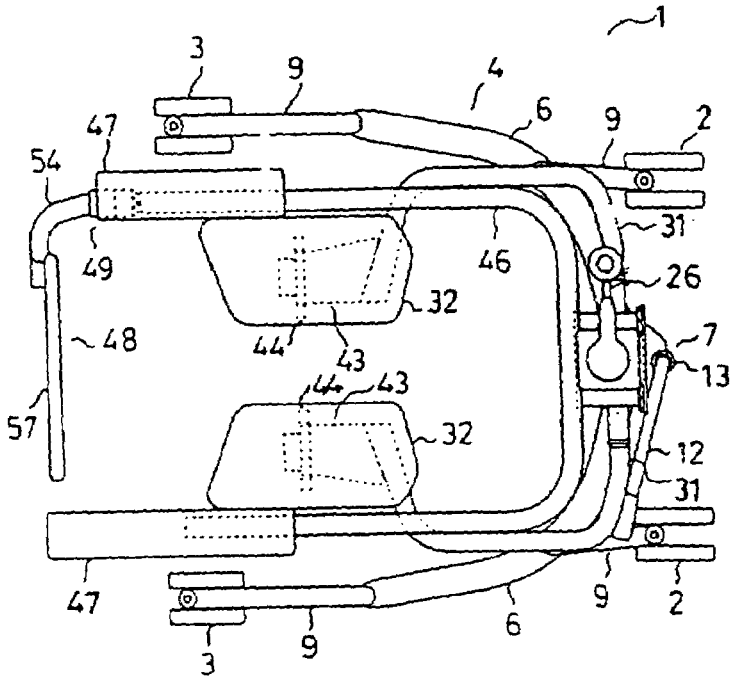
FIG. 1 is a plan entire view showing a supportive device according to the present invention.
Figure 2:
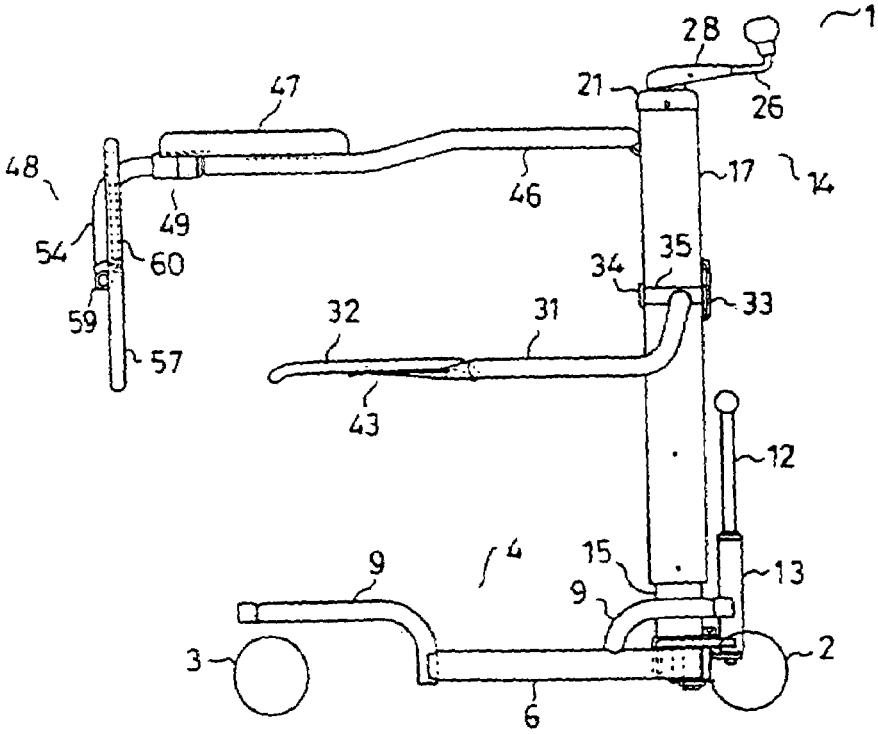
FIG. 2 is a side view of the supportive device.
Figure 3:
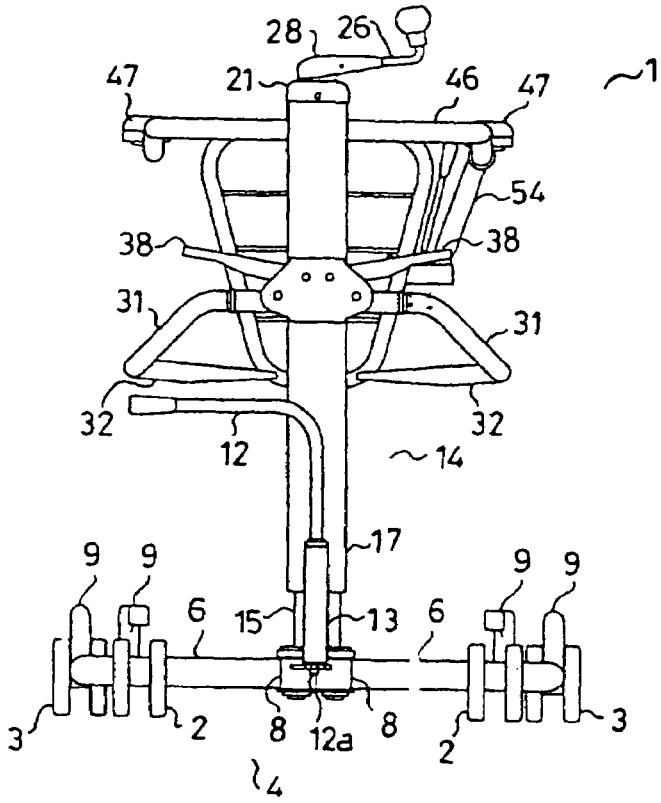
FIG. 3 is a front view of the supportive device.
Figure 4:
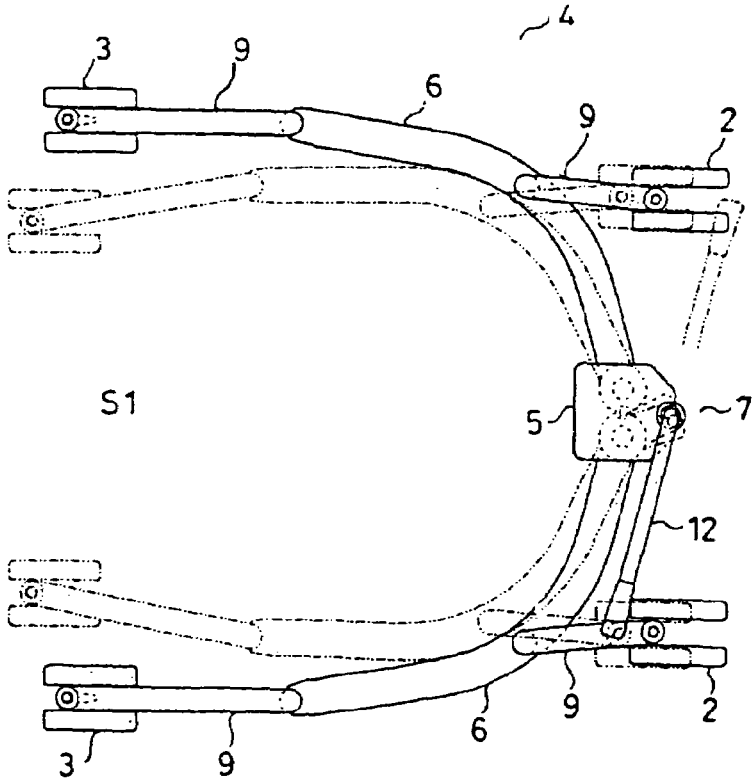
FIG. 4 is a plan view showing the chassis used in the supportive device.
Figure 5:
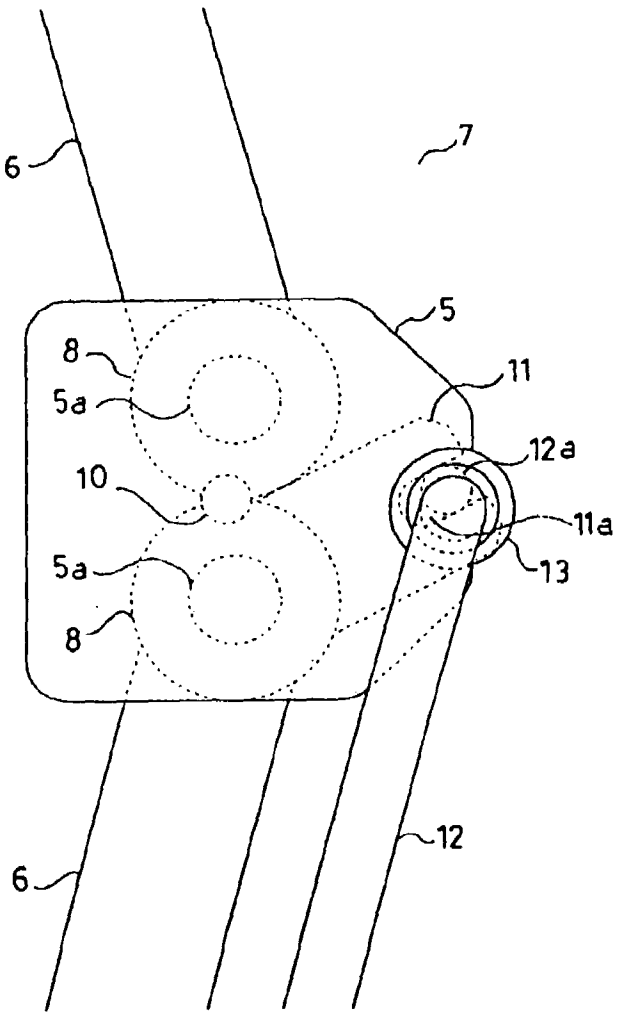
FIG. 5 is a schematic view exemplifying the expanding mechanism used in the supportive device.

The illustrated supportive device 1 includes a chassis 4 having a pair of front wheels 2 and a pair of rear wheels 3. As best shown in FIG. 4, the chassis 4 is constituted by a base 5 and arms 6 extending rearward with a space S1 therebetween which opens rearwards. An expanding device (hereinafter 'expander') 7 is optionally provided in the chassis 4 whereby the arms 6 are expanded or contracted to adjust the width of the chassis 4.

The base 5 is L-shaped, and is provided with a pair of shafts 5*a* which rotatably carry bearings 8 coupled to the ends of supports 6. The supports 6 are slightly curved in the form of Letter L in its plan view, and provided with L-shaped caster supports 9 at its front and rear ends. The bearings 8 include a groove in which a key 10 fits, thereby effecting a unitary rotation of the bearings 8 in accordance with the rotation of either of them. One of the bearings 8 is provided with a plate 11 projecting forward. The plate 11 is provided with a hole 11*a* through which a pin 12*a* secured to an operating lever 12 (which will be described below). The operating lever 12 is carried in a sleeve 13. The lever 12 is provided with a pin 12*a* eccentrically fixed to the lever 12 such that the rotation of the lever 12 causes one of the bearings 8 integral with the plate 11 to rotate. Then the other bearings 8 follow the movement of the key 10. In this way, the width of the supports 6 of the chassis 4 is adjusted by operating the lever 12.

In the illustrated embodiment the bearings 8 are widened or narrowed by the key 10 but instead of using the key 10, mutually engaging gears can be employed.

Figure 6:
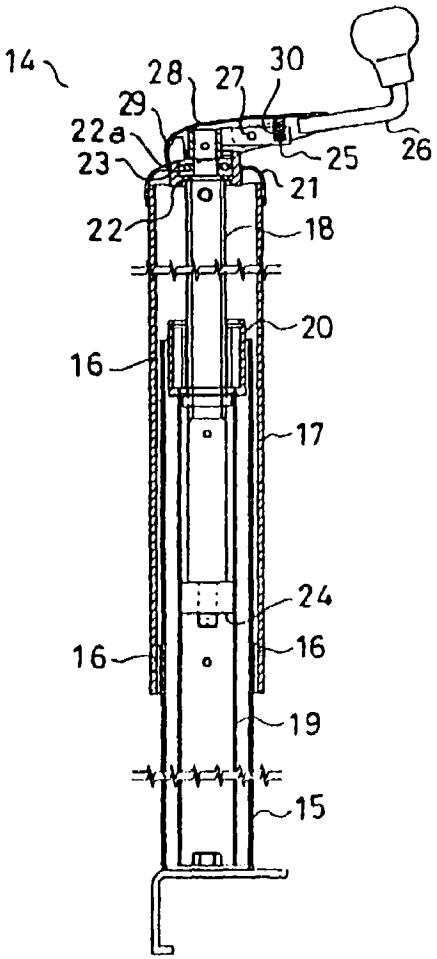
FIG. 6 is a side view showing the pillar used in the supportive device of FIG. 1.

The supportive device 1 includes a pillar 14 on which a lifting device is provided; in the illustrated embodiment the pillar is rectangular in cross-section. As shown in FIG. 6, the pillar 14 includes an inner framework 15 erected on the base plate 5, and an outer frame 17 slidably provided on the inner framework 15 through linings 16, the inner framework 15 and the outer framework 17 carry the lifting device, the lifting device being more particularly described below:

The pillar 14 includes a screw bar 18 threadable with an engager 20 secured to a cylindrical sleeve 19 provided inside the inner framework 15. The upper end of the sleeve 19 is journaled to a metal 22 through a bearing 23, the metal being fixed to the outer framework 17 through a bracket 21. The engager 20 is prevented from deviation by a collar 24 secured to the screw bar 18. The metal 20 is provided with a pawl 22*a* in its periphery. The reference numerals 25 and 26 denote a lever pinned to an upper end of the screw bar 18, and denotes an operating handle 26 which is secured to a metal 28 journaled to the lever 25 by a pin 27, respectively. The reference numeral 29 denotes an engager provided in the metal 28. The reference numeral 30 denotes a spring interposed between the metal 28 and the lever 25, designed to bias the metal 28 upward. When the operating handle 26 is lowered against the spring 30, the pawl 22*a* is disengaged from the engager 29, thereby making the screw bar 18 ready for rotation.

The outer framework 17 is provided with a pair of crank-like arms 31 circling a patient (M)'s leg portion, each arm 31 including a thigh support 32. The outer frame 17 is provided with brackets 33 and 34 at its front and back, respectively. The arms 31 are rotatably supported by a shaft 36 through a bearing unit 35 secured thereto. The reference numeral 37 denotes a flange secured to the front end of the bearing unit 35. The flange 37 is provided with recesses 37*a* and 37*b* with which the lever 38 is engaged.

The arms 31 can be held upward and downward as desired. More particularly, the arms 31 are moved in a circular course passing the patient's knees around the shaft 35, and are inserted into a triangular space S2 formed between the patient's thighs and the target structure such as a bed on which the patient sits, the space S2 taking the form of Letter C with is open rearward. The bearing unit 35 is located between the brackets 33 and 34 such that it is rotatable around the shafts 36.

Figure 7:
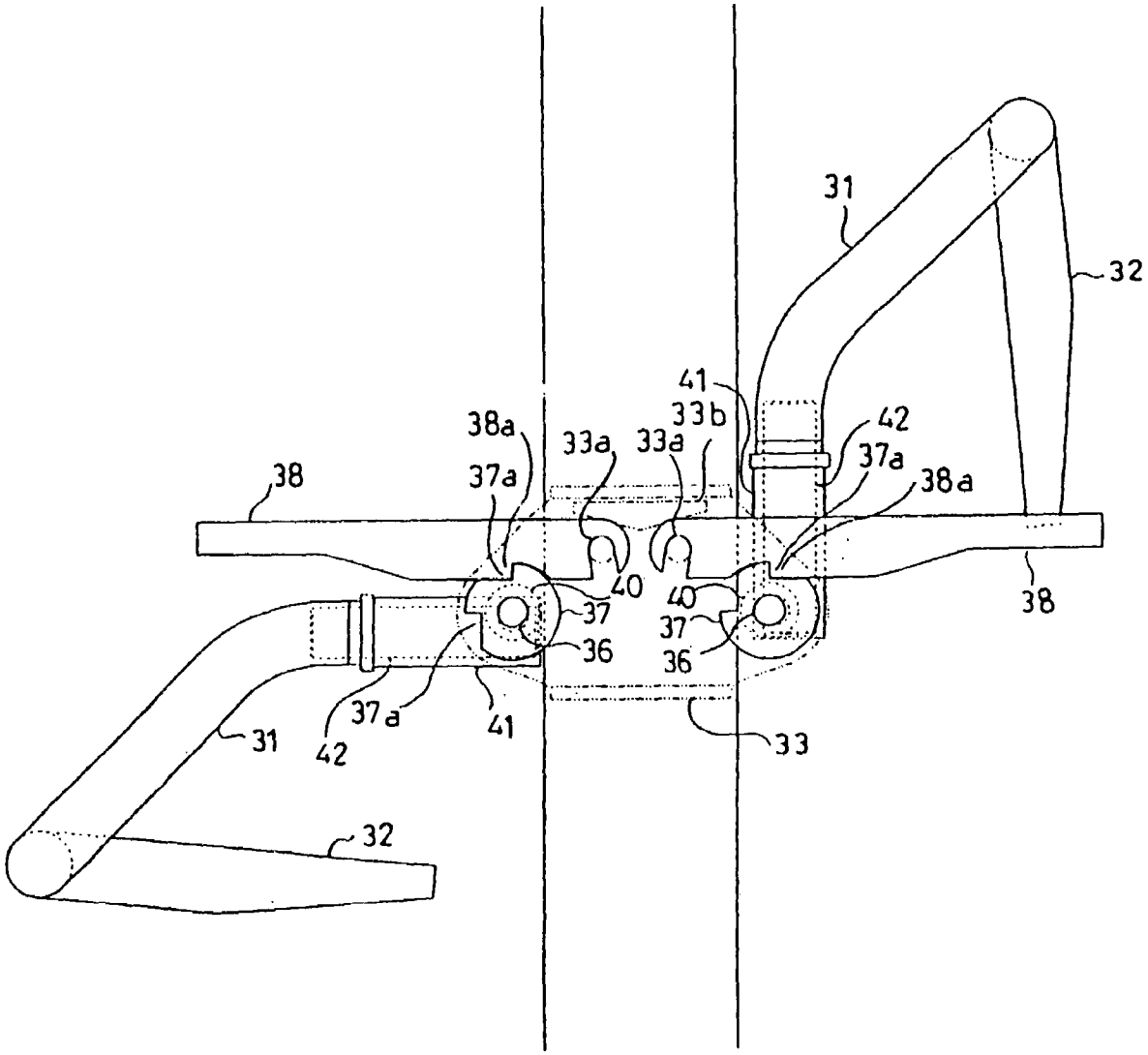
FIG. 7 is a schematic view exemplifying a part in which the arms are fixed to the supportive device.

As shown in FIG. 7, each of the shafts is provided with a flange 37 having a recess 37*a*. The recess 37*a* is adapted for engagement with a pawl 38*a* of a lever 38 engaged by a pair of shafts 33*a*, thereby limiting the opening angle of the arms 31. The lever 38 is prevented from slipping off by a plate 33*b*.

Figure 8:
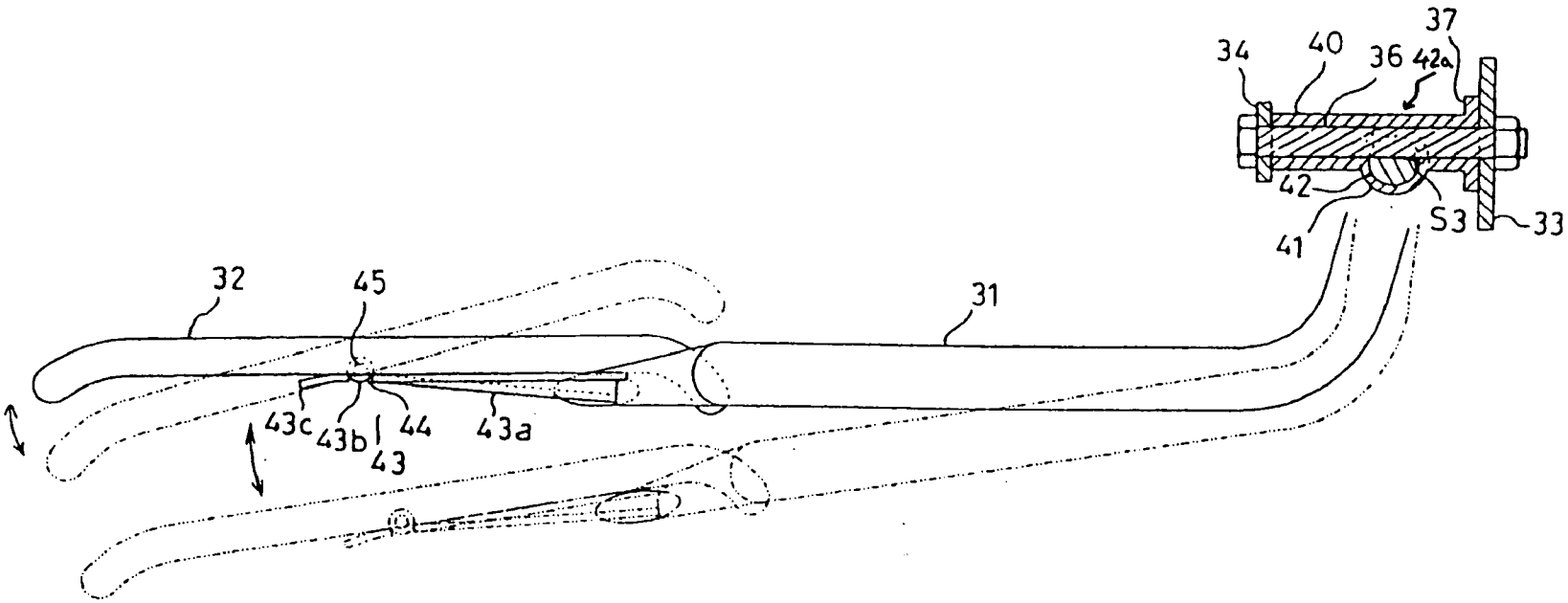
FIG. 8 is a schematic view exemplifying a manner in which the thigh supports operate.

FIG. 8 shows another example of the displacing device, in which like reference numerals denote like components and elements. A first bearing unit 40 is axially provided, and a second bearing unit 41 is provided traversely both between the brackets 33 and 34 such that shafts 36 and 42 carried in the respective bearings can intersect. The brackets 33 and 34 have the same structure as those referred to above. The traverse bearing unit 41 is passed by a shaft 42 secured to the base of the arm 31, and the axial bearing unit 40 is pivoted by a shaft 36 between the brackets 33 and 34. The shaft 42 is provided with a groove 42*a* at which it intersects with the shaft 36. A gap S3 is provided between the shafts 36 and 42, thereby ensuring that the arms 31 are horizontally rotatable when they are positioned upward. As a result, the thigh supports 32 are spaced at an adequate interval.

The thigh supports 32 are supported by a supporter 43 at the rear ends of the arms 31. The supporter 43 includes a plate 43*a* projecting from the arm 31, a bearing 43*b* at the end of the plate 43*a*, and an angular limiter 43*c* secured to the bearing 43*b*. The bearing 43*b* and the thigh supports 32 are provided with a bearing 44 such that the bearing can rotate about a pin 45. In this way, the thigh support can be adequately adjusted to the patient (M)'s sitting position, and can recline as desired, with his or her thigh portions being supported by the supports 32. No local application of load is avoided to the patient's thigh portion. The bearing 43*b* is located at a central part of each of the thigh supports 32.

A C-shaped handrail 46 is secured to the outer framework 17 above the arms 31 the trail 46 having a pair of arm rests 47.

Figure 9:
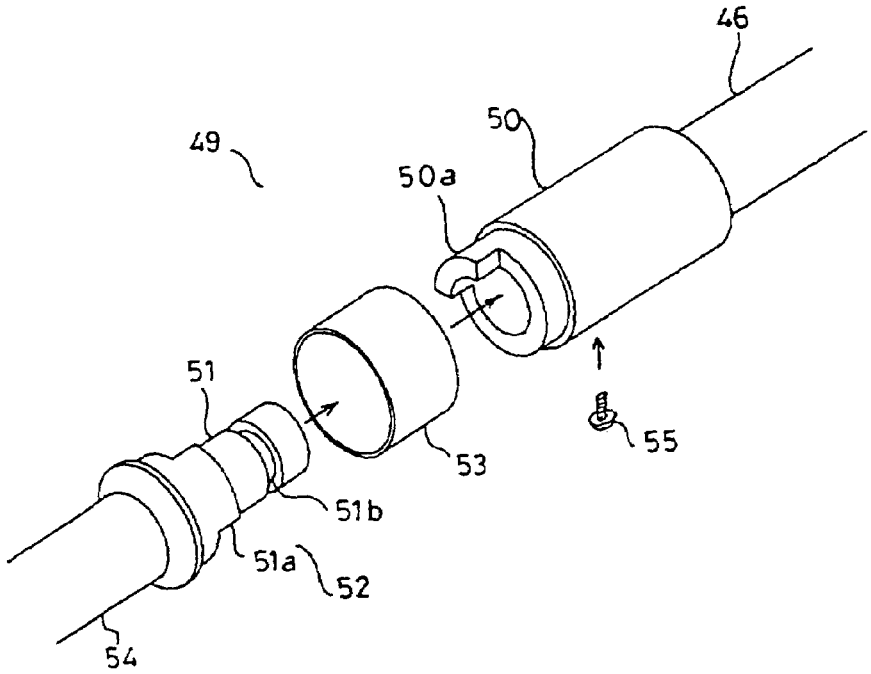
FIG. 9 is a view exemplifying a manner in which the back upholstery operates.
Figure 10:
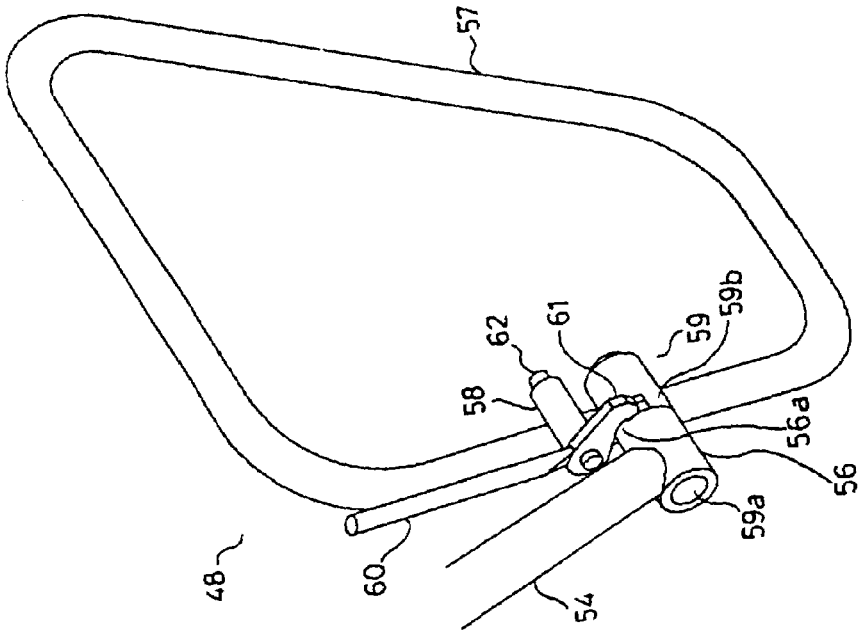
FIG. 10 is a schematic view exemplifying a means whereby the back upholstery is inclined.
Figure 11:
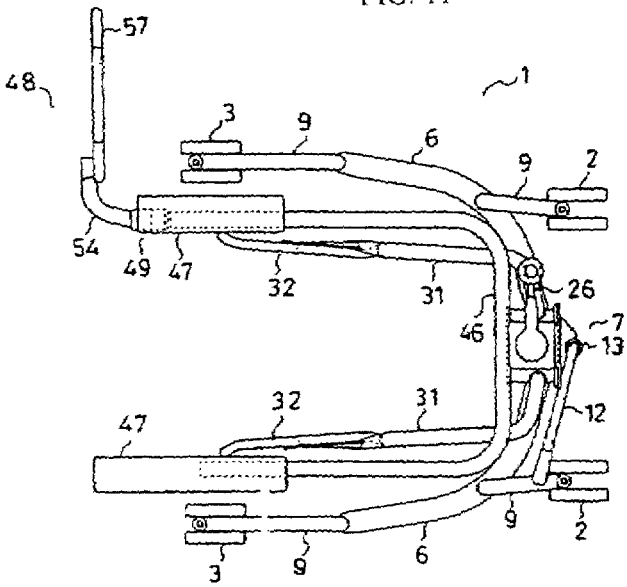
FIG. 11 is a plan entire view showing the supportive device before a patient rides on it.
Figure 12:
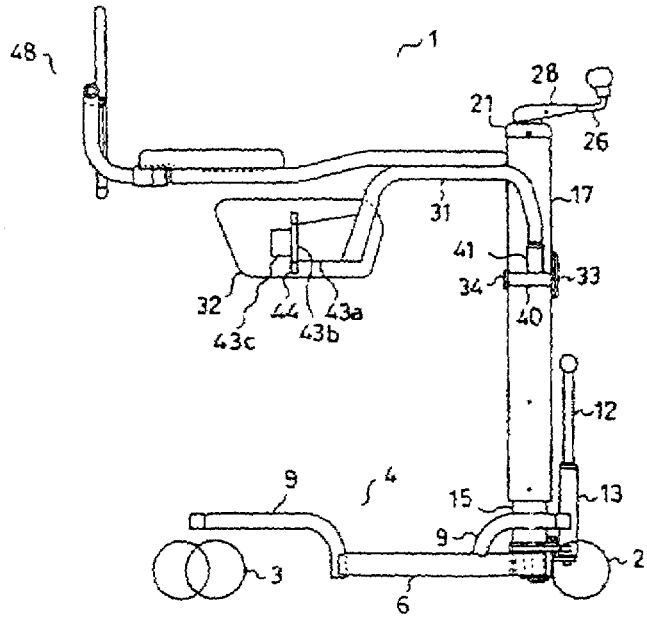
FIG. 12 is a side view showing the supportive device of FIG. 11.
Figure 13:
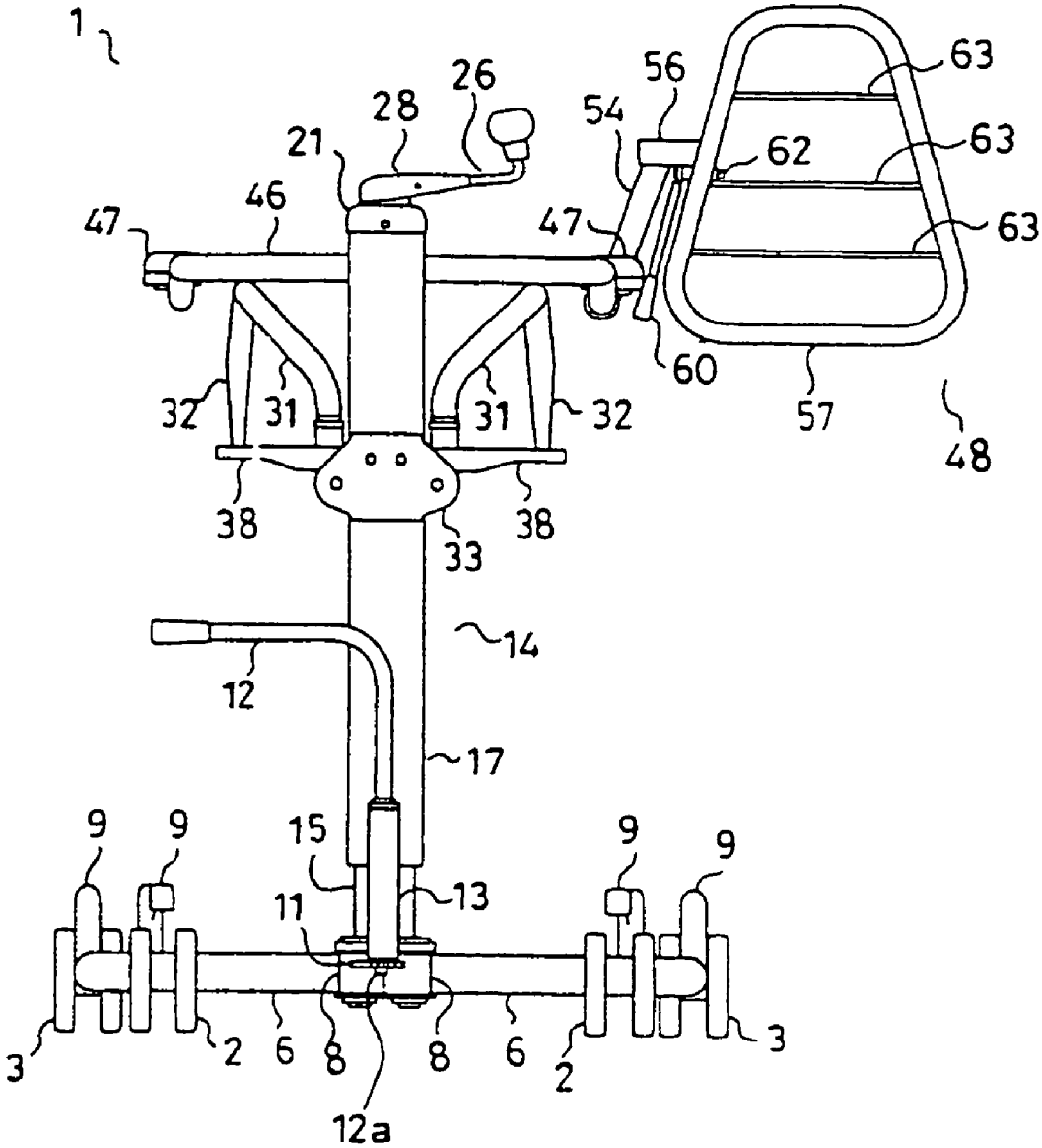
FIG. 13 is a front view showing the supportive device of FIG. 11.

A back upholstery 48 is provided in opposition to the thigh supports 32, the back upholstery being connected to a rotary device 49 provided in an end of the handrail 46. As shown in FIG. 9, the rotary device 49 includes a hollow cylinder 50 fitted with an engaging pawl 50*a* at one end, and a shaft 52 having a shaft 51 fitted with an engaging pawl 51*a* passable through the cylinder 50. When the shaft 52 is inserted into the cylinder 50 with the engagement of the pawl 50*a* with the pawl 51*a*, the overlapping part is covered with a ring 53. The shaft 52 is connected to an L-shaped pipe 54 for connection of the back upholstery 48. The shaft 51 is provided with a groove 51*b*, and after being passed through the cylinder, it is fixed by a screw 55. In this way, the pipe 54 can be rotated in the angular range in which the pawls 50*a* and 51*a* come into contact with each other (in the illustrated embodiment it is set to 180°).

The pipe 54 is connected to a hollow cylinder 56 at the other end, the cylinder 56 including a pawl 51*a*. A back upholstery frame 57 is secured to a hollow cylinder 58, and a shaft 59 having a pawl 59*b* at its periphery of the shaft 59*a*. The cylinder 58 is provided with a locking member 61 through a pin 62 in a rotatable manner, the locking member 61 being fixed to the lever 60, and the shaft 59 being pivotally connected to the cylinder 56. In this way, the locking member 61 is rotatable from a point where it is engaged with the pawl 56*a* up to a point where the pawl 56*a* comes into contact with the pawl 59*b* as a result of the rotation of the locking member 61. The reference numeral 63 denotes an enforcement. The back upholstery frame 57 includes a cover (not shown) which contains a cushion at its periphery.

In the illustrated embodiment the back upholstery 48 is provided at one end of the handrail 46 but it can be provided at both ends thereof such that the paired one is independently rotatable.

Figure 14:
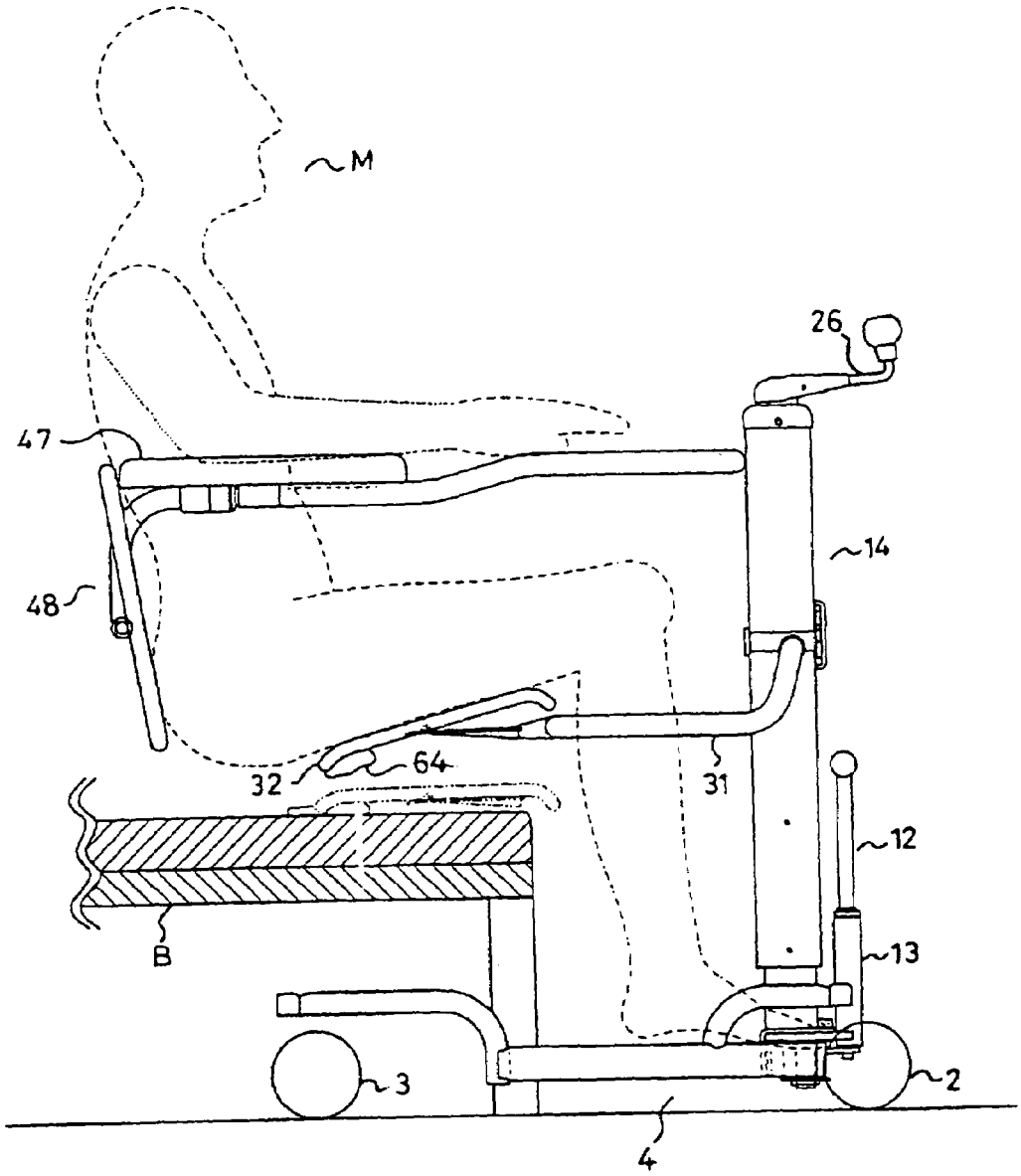
FIG. 14 is a schematic view exemplifying a means for preventing a pinching trouble.

FIG. 14 shows a further preferred embodiment, characterized by the provision of a balloon-like bag 64 fixed on the undersurface of the thigh support 32. The bag 64 contains a fluid material such as liquid or gas, thereby preventing the patient's thigh from being pinched between the support 32 and a structure such as a bed by allowing the bag 64 to become elastically deformed or expanded.

To carry the handicapped patient (M) away from a bed (B), let him or her sit on the edge of the bed (B). If the patient (M) stays at a toilet or a supportive chair, he or she need not move or stand up.

Then, the supportive device of the invention is drawn as near the patient (M) as possible, by expanding the thigh supports 32 upwards until the patient (M) can enter the space S1. The width of the chassis 4 can be adjusted according to the circumstances by operating the lever 12.

The supportive device 1 is moved to a point where the thigh supports 32 is positioned alongside the patient's thigh. The thigh supports 32 can be spaced at an adequate interval so as to allow a relatively large supportive chair to anchor therein.

Figure 15:
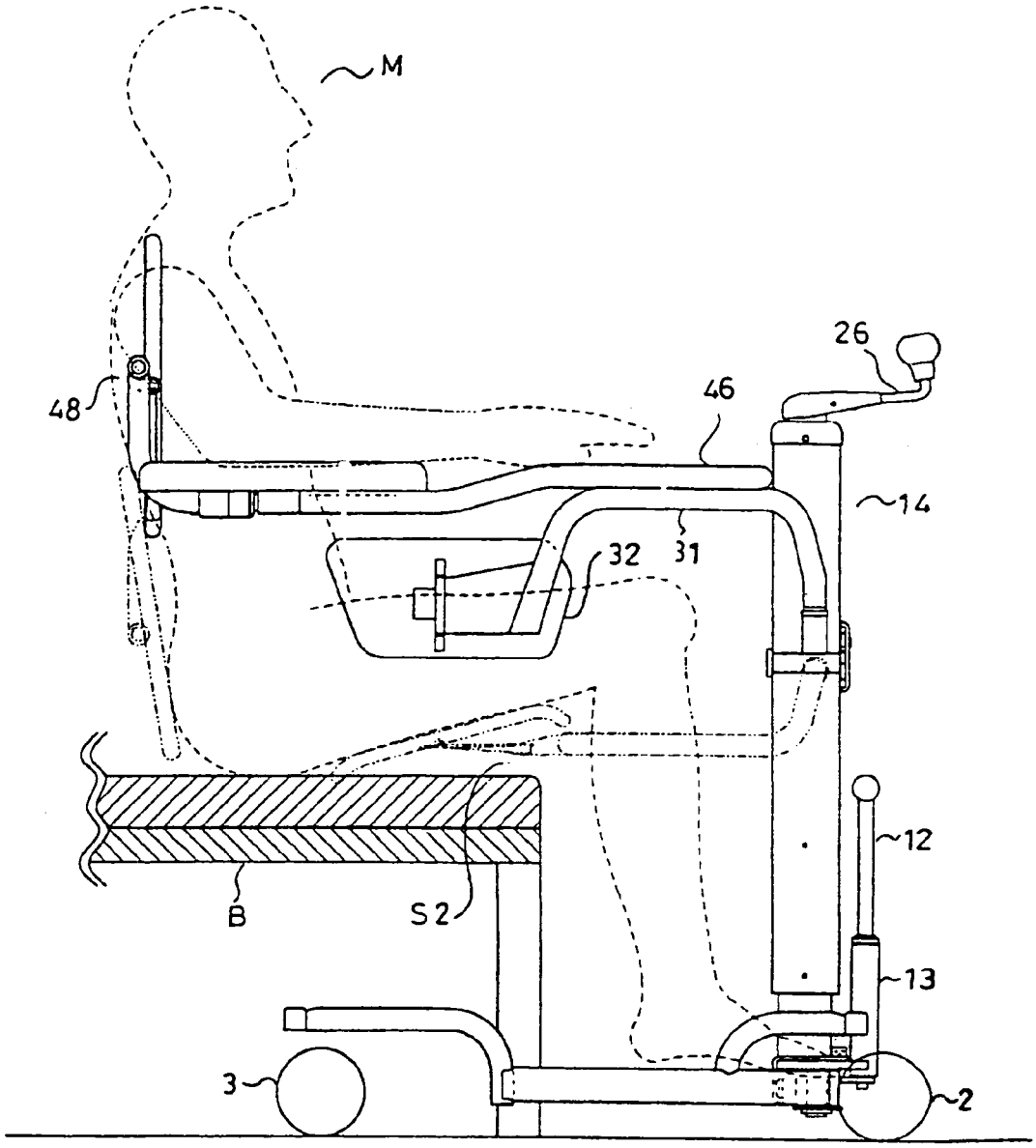
FIG. 15 is an entire side view showing a state in which the patient is ready for shift.
Figure 16:
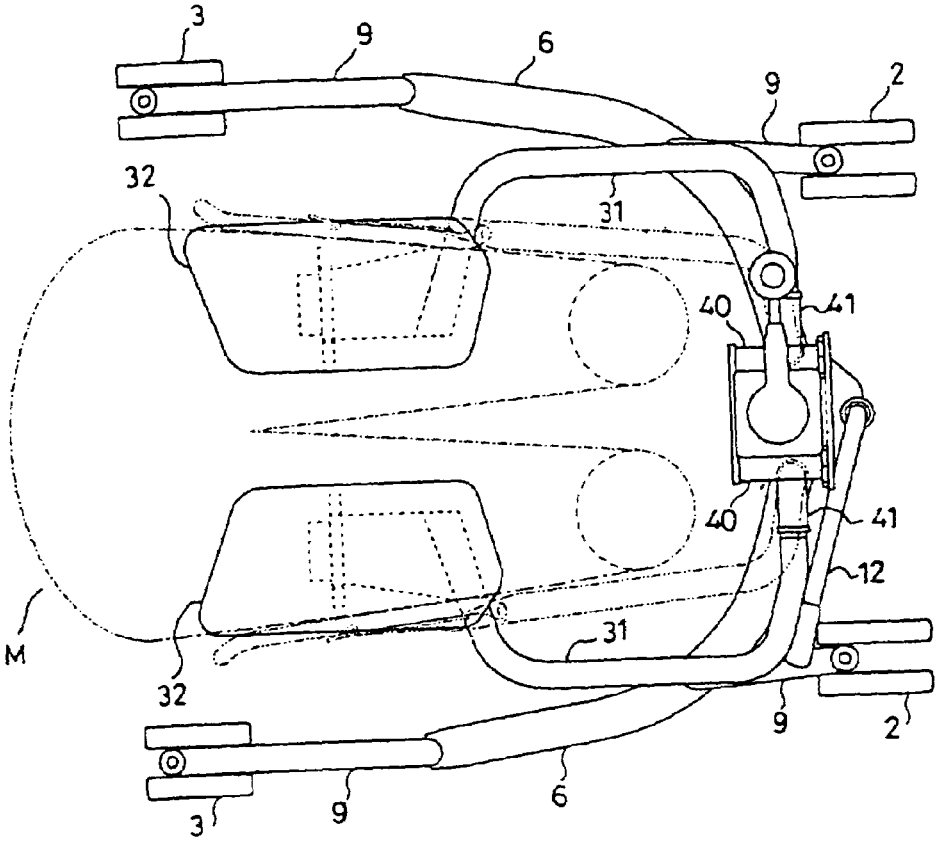
FIG. 16 is a plan view showing the action of the arms wherein the handrail and the back upholstery are omitted for illustration purpose only.

The height of the thigh supports 32 can be adjusted by the lever 26 according to the height of the patient (M). After the adjustment is finished, the thigh supports 32 are rotated from its upper position to its lower position, and as shown in FIG. 15, they are inserted into a triangular space S2 formed between the patient's thigh and the bed (B) (or a chair). The thigh supports 32 are rotatably inserted along the patient's thighs because of the structure in which the shaft 36 as a pivot is situated in the extension of the patient's thighs.

Then, the back upholstery 48 is rotated along the back of the patient (M) to enable him or her to lean against it.

To raise the thigh supports 32, the lever 26 is rotated, thereby taking the patient (M) away from the bed (B) by his or her body. In this case, a reclining device mounted in the thigh supports 32 makes the thigh supports 32 decline in accordance with the patient's position, bearing the whole weight of the patient (M). The patient can feel comfortable in shifting from one structure such as a bed to other such as a supportive chair. The back upholstery 48 is also provided with a reclining device whereby the back upholstery 48 is ready to conform to the contour of the patient's back.

Then, the patient is shifted from the supportive device to the bed (B), and let him or her sit thereon by operating the lever 26. In this case, the bag 64 protects the patient from his or her thigh being pinched between the bed and the thigh supports 32 by expanding rearward.

After the patient has sat down on the bed, the thigh supports 32 are rotated upward, and the back upholstery 48 is also rotated outward from the patient's back. Finally, the supportive device 1 is pulled away from the bed.

The patient can use a toilet while staying in the supportive device 1 owing to the open structure of the below the patient's buttocks.

In this way the patients can be shifted from the bed to the supportive device, and vice versa, without the necessity of standing up in the supportive device 1 or being suspended by a belt or the like. In this situation the patients will have to feel stable and comfortable.

The thigh supports 32 can be easily inserted under the patient's thighs through the triangular space S2 formed between the bed and the thighs.

The thigh supports 32 and the back upholstery 48 can recline such that they conform to the back of the patient sitting on the supportive device and keep him or her at an agreeable angle.

The supportive device can be applied to patients of any physique by raising the thigh supports upward.

As the patients are shifted from the bed to the supportive device, and vice versa, while sitting on the supportive device 1, which means that they need not stand up or be suspended by a belt or the like. The patients shift from the supportive device to a bed or a supportive chair and vice versa with ease.

Figure 17:
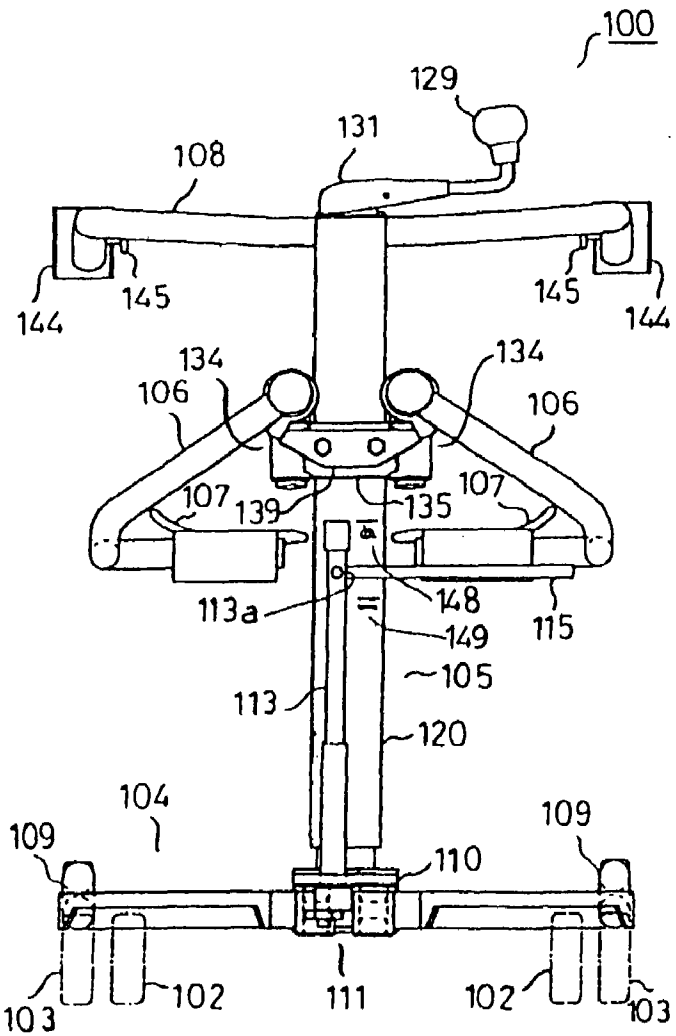
FIG. 17 is a plan entire view showing a modified version of the supportive device according to the present invention.

Referring to FIG. 17 and thereafter, an alternative embodiment will be described:

The illustrated supportive device 100 includes a chassis 104 having a pair of front wheels 102 and a pair of rear wheels 103, a pillar 105 having a pair of arms 106, thigh supports 107, and handrails 108 above the thigh supports 107.

Figure 21:
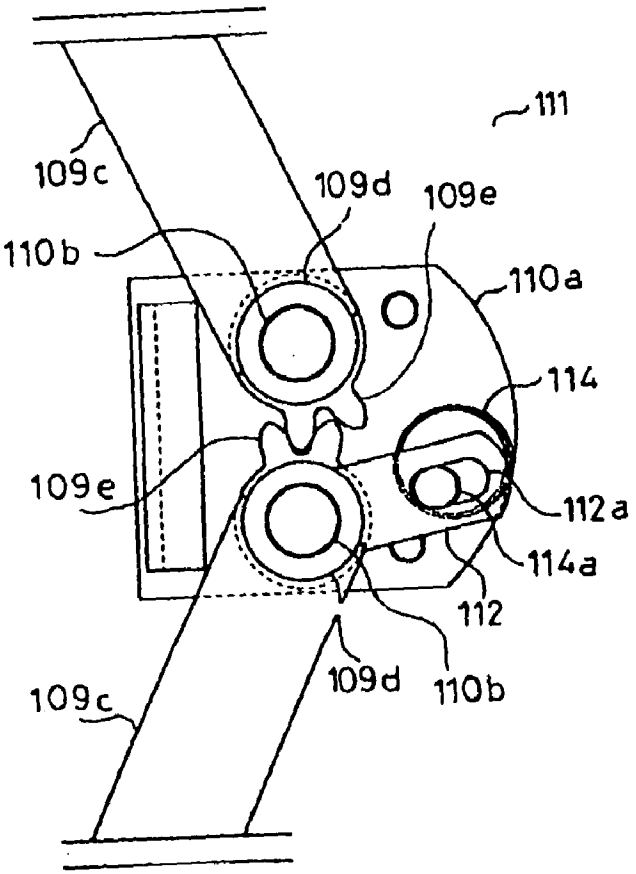
FIG. 21 is a schematic view exemplifying the expanding mechanism used in the support device of FIG. 17.
Figure 22:
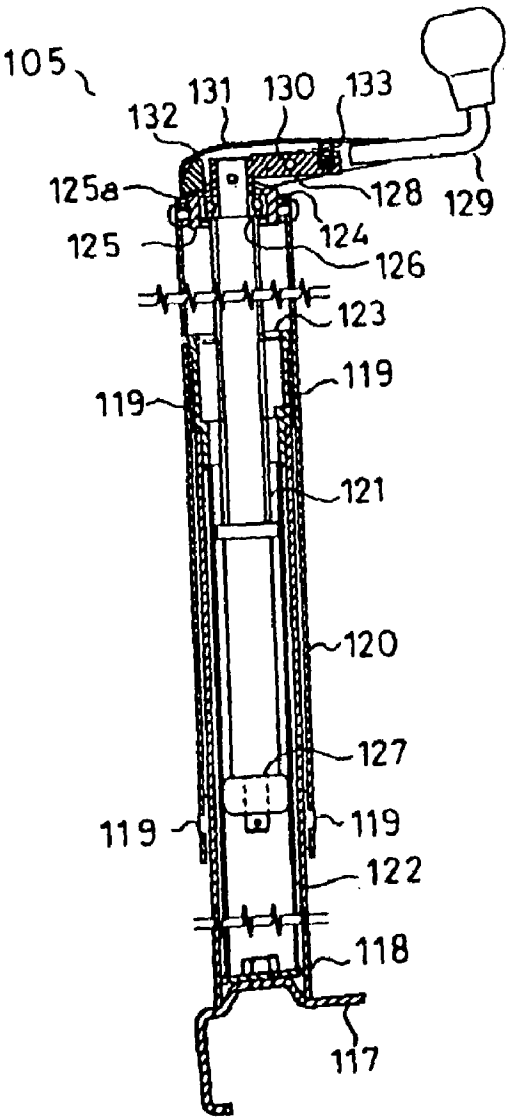
FIG. 22 is a side view showing the pillar used in the supportive device of FIG. 17.

The chassis 104 is mainly composed of a base 110, a pair of supporting frames 109, and an expanding device (hereinafter 'expander') 111. As shown in FIG. 21, each supporting frame 109 carries one end of a front frame 109*c* forward a traverse beam 109*b* integral with a fixing member 109*a* of the rear wheels 103, and the front frame 109*c* has a bearing unit 109*d* at the other end. The bearing unit 109*d* is provided with a toothed member 109*e*, and a footrest 109*f* secured thereto.

The base 110 is composed mainly of an L-shaped plate 110*a*, a pair of vertical shafts 110*b* extending from the undersurface of the plate 110*a*, and a vertical cylinder 110*c* secured in a hole formed in its front part.

The expander 111 carries the bearing units 109*d* pivoted to the shafts 110*b* of the base 110 in a state where the toothed members 109*e* are mutually engaged. One of the bearing units 109*d* is provided with a plate 112 having a hole 112*a* in which a shank 114*a* of an eccentric cam 114 secured to a lower end of a lever 113 passed through the cylinder 110*c*. The lever 113 is provided with a hole 113*a* in its upper part, and carries an L-shaped lever 115.

More particularly, the chassis 104 is rotatable in accordance with the rotation of the lever 115, and allows one of the supporting frames 109 to rotate around the shaft 110*b*. The other supporting frame 109 rotates in association with the engagement of toothed members 109*e*, thereby allowing it to open and close. A space S1 is formed behind the supporting frame 109, so that the chassis 104 (i.e. the supportive device) can be inserted into a target structure such as a supportive chair (K) and a toilet by expanding or contracting or retreating the chassis 104. Footrests 109*f* are provided with wheels 102 on their undersurface. Owing to the presence of the wheels 102, the patients are protected from their feet or fingers being pinched while the wheels are rotated.

The pillar 105 is rectangular in cross-section in this embodiment, and provided with a lifting device. The pillar 105 is additionally provided with an L-shaped plate 117 fixed to the base 110, and with a sliding framework 120 through linings 119 around a framework erected on the L-shaped plate 117. The lifting device is mounted on the framework 118 and the sliding framework 120, the lifting device being more particularly described below:

The reference numeral 121 denotes a screw bar in mesh with a screw 123 secured to the upper part of the cylidner 122 housed in the framework 118. Its upper end is received in a metal 125 through a bearing 126, the metal being secured to the sliding framework 120 through a bracket 124. The reference numeral 127 denotes a stop collar fixed to a lower end of the screw 123.

The reference numeral 125*a* denotes a pawl secured to an upper end periphery of the metal 125. There is provided a lever 128 pinned to an upper end of the screw 121. There is also provided a rotary lever 129 which is secured to the metal 131 pivoted to the lever 128 by a pin 130. The reference numeral 132 denotes an engager secured to the metal 131.

A spring 133 is provided between the metal 131 and the lever 128, so as to bias the metal 131 upward. When the lever 129 is lowered against the spring 133, the pawls 125*a* and 132 are disengaged from each other, thereby allowing the screw 121 to rotate.

The sliding framework 120 is provided with a rotary bearing unit 134 in its middle portion, the bearing unit supporting arms 106 that they come down in rotation from their upper positions. The rotary bearing unit 134 includes a cylinder 136 secured to a bracket 135 fixed to the pillar 105, and a rotary boss 137 which consists of a cylinder 137*b* secured to an upper part of the shaft 137*a* pivoted to the cylinder 136. The cylinder 137*b* is provided with a pawl 137*c* at its front end.

The sleeve 136 or the sleeve 137*b* of the rotary boss 137 can be declined rearward, thereby bringing the bearing unit 107*a* of the thigh supports 107 to below the rotary bearing unit 134. This is effective to prevent the rotary bearing unit 134 from hitting the patient (M)'s knees, thereby eliminating the necessity of making the arms 106 short. As a result, the supportive device 1 can be compact.

Figure 24:
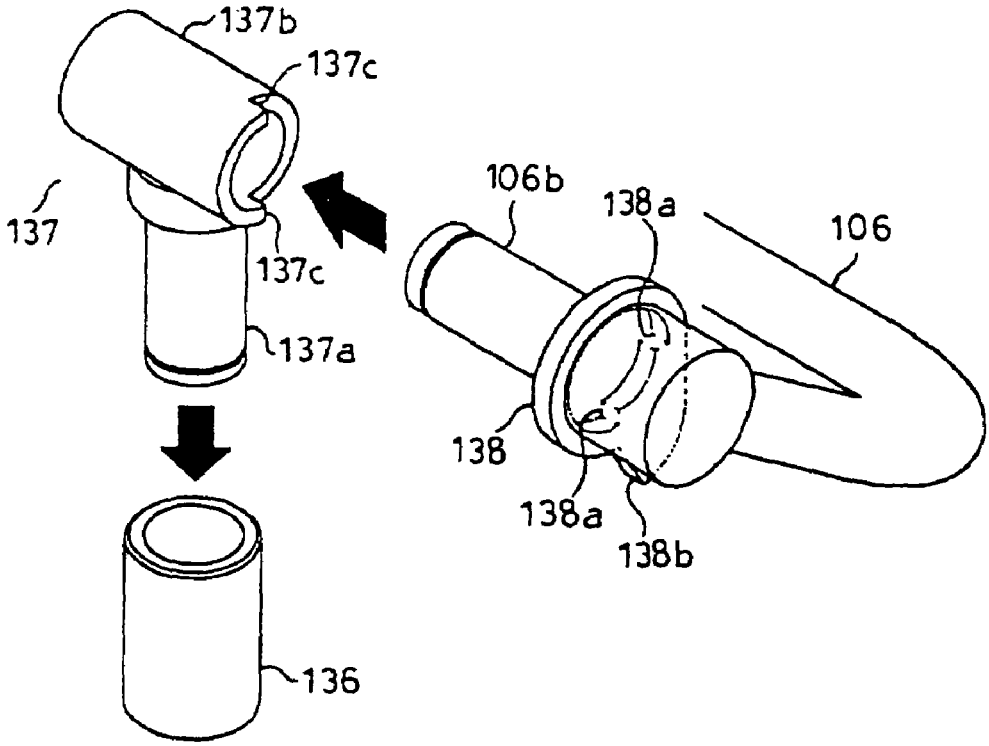
FIG. 24 is a perspective view showing the rotary bearing of FIG. 23.
Figure 25:
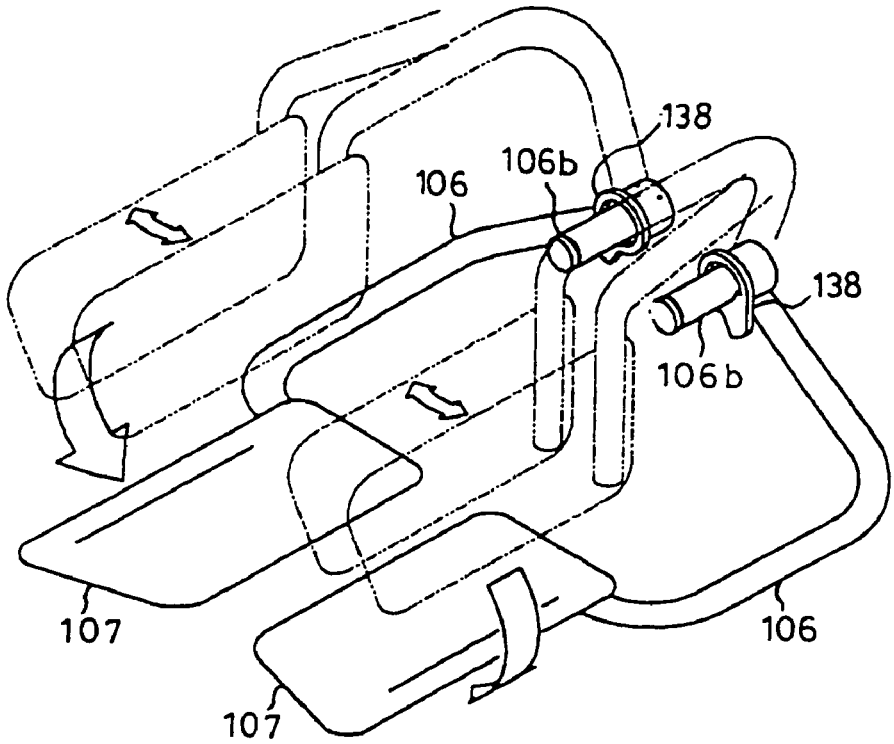
FIG. 25 is a perspective view showing the actions of the arms and thigh supports used in the supportive device of FIG. 17.

As shown in FIG. 24, the arm 106 is substantially C-shaped, and includes an engager 106*a* for limiting the rotation of the thigh support 107, and a shaft 106*b* rotatably integral with the sleeve 137. The shaft 106*b* is provided with a stopper 138 having pawls 138*a* and 138*b*. In this way the arms 106 is rotatable in a range in which the pawl 137*a* can come into contact with the pawl 138*a* of the stopper 138. The sleeve 137*b* stands away from the side of the pillar 105, thereby allowing the arms 106 to come into contact and out of contact with their rear ends around the shaft 137*a*.

There is provided an adjuster 139 secured to the bracket 135, having a lengthy hole through which the adjuster is slidable. The adjuster 139 is provided with a pair of pawls 139*b* with which the pawls 138*b* of the stopper come into contact, thereby limiting a range of rotation of the rotary boss 137 around the shaft 137*a*. This means that an adequate space interval between the thigh supports 107 is maintained.

Figure 23:
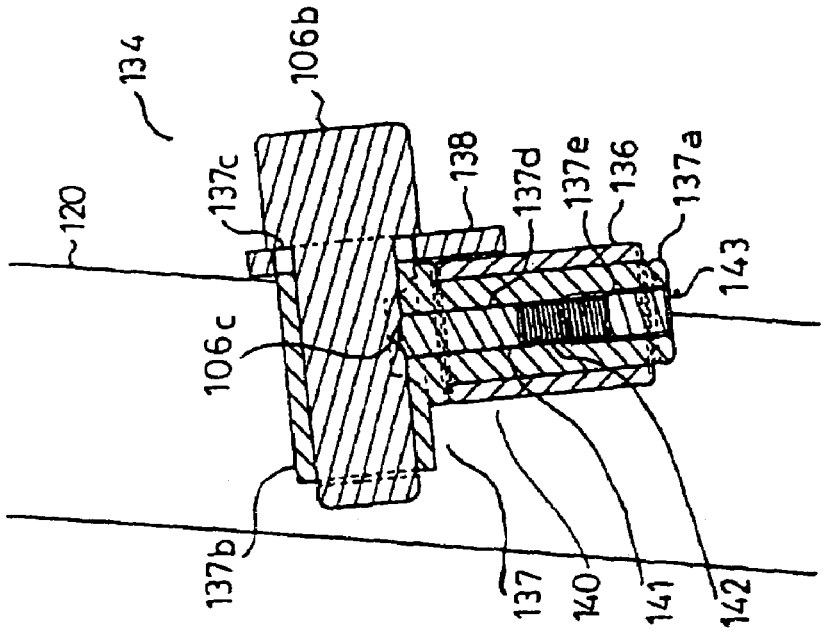
FIG. 23 is a cross-sectional view showing a main part of the rotary bearing used in the supportive device of FIG. 17.

As shown in FIG. 23, the arms 106 is held upward by an automatic locking device 140. The automatic locking device 140 is designed to adjust the pressing strength of a presser 141 through male threads 143, under the structure in which the shaft 137*a* of the rotary boss 137 is provided with a hole 137*d* and female threads 137*e* through which the presser 141 and a spring 142 are inserted. The presser 141 is held when it is engaged with a hole 106*c* formed in the shaft 106*b* secured to the end of each arm 106. In the illustrated embodiment the presser 141 is a bar having a spherical tip but it may be made of a ball.

Figure 18:
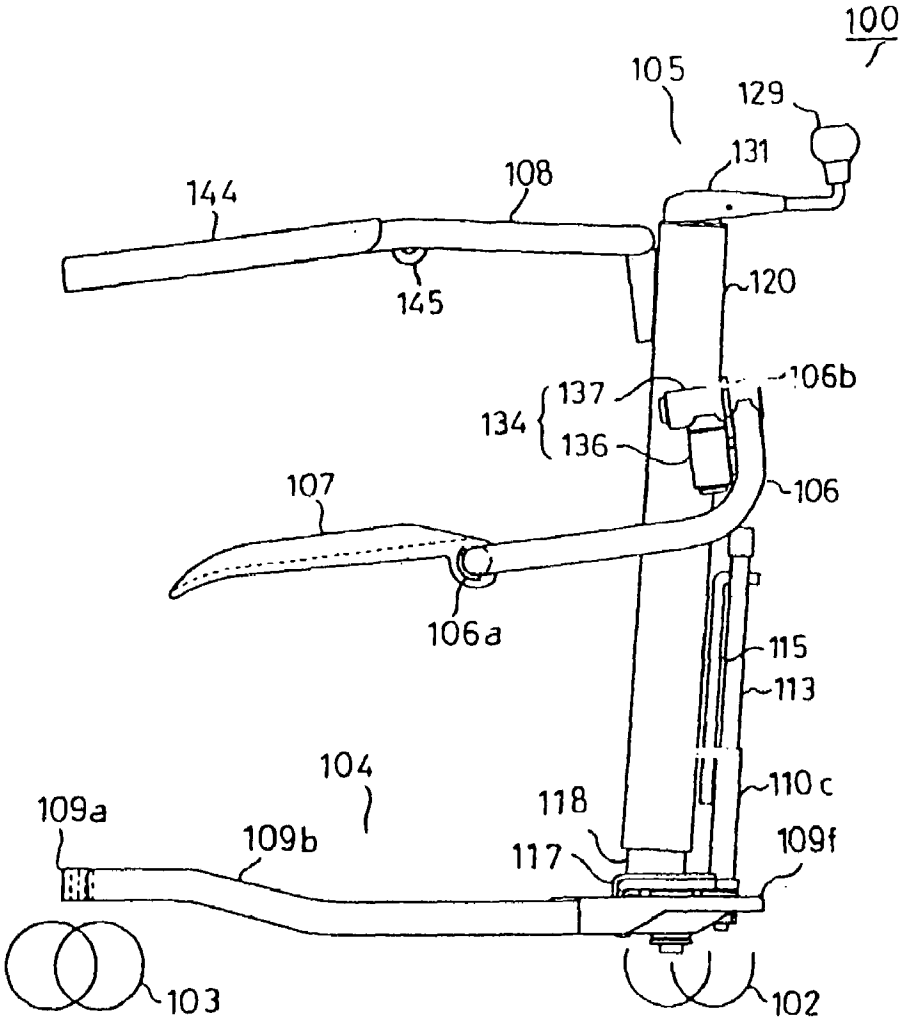
FIG. 18 is an entire side view of the supportive device of FIG. 17.
Figure 19:
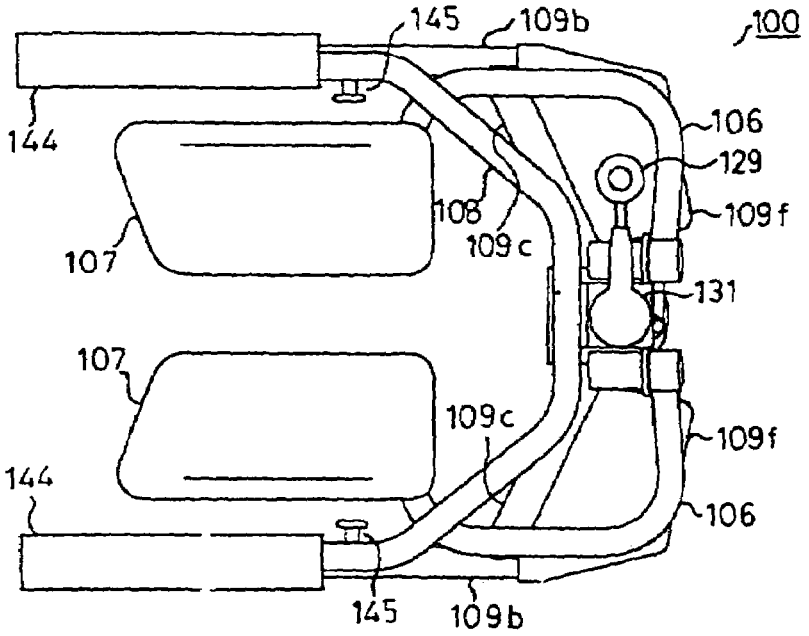
FIG. 19 is an entire front view of the supportive device of FIG. 17.
Figure 20:
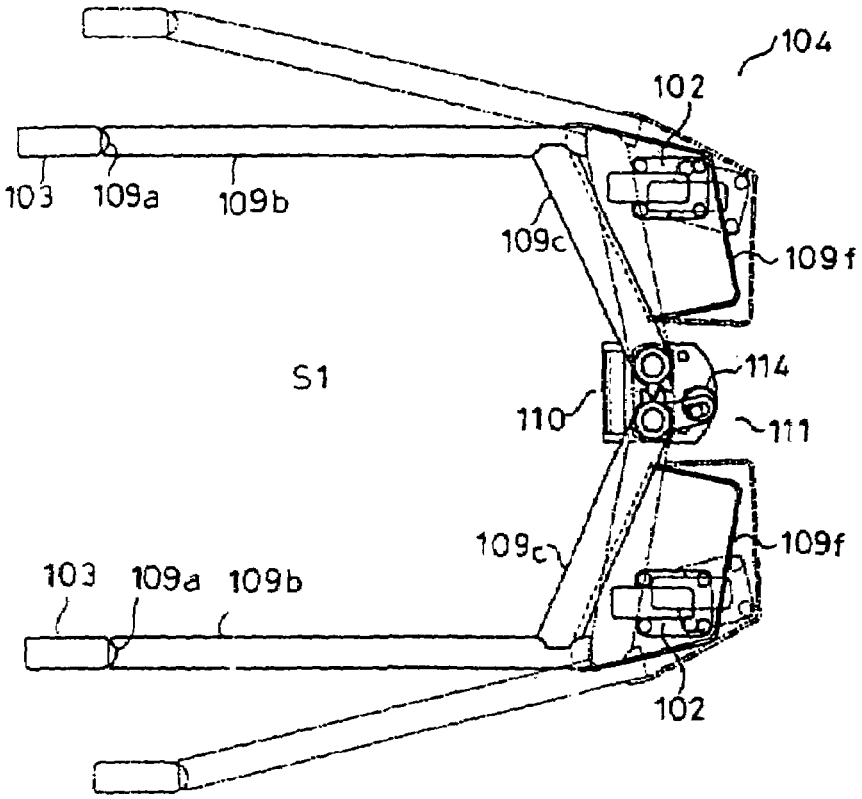
FIG. 20 is a bottom view showing the lower framework.
Figure 26:
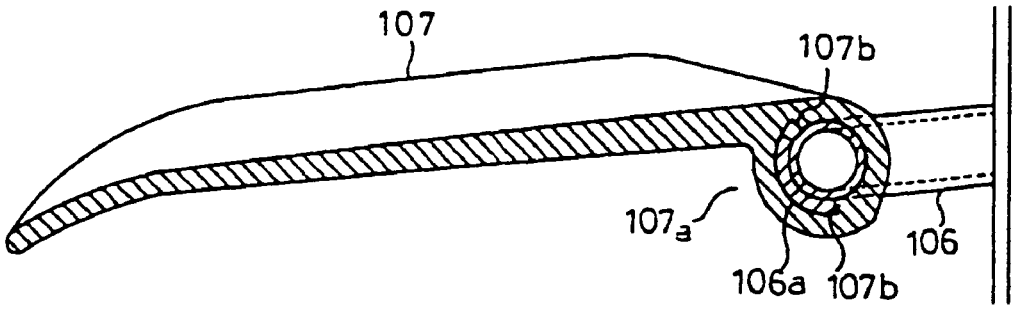
FIG. 26 is a cross-sectional side view showing a part where the thigh supports are fixed to the supportive device of FIG. 17.
Figure 34:
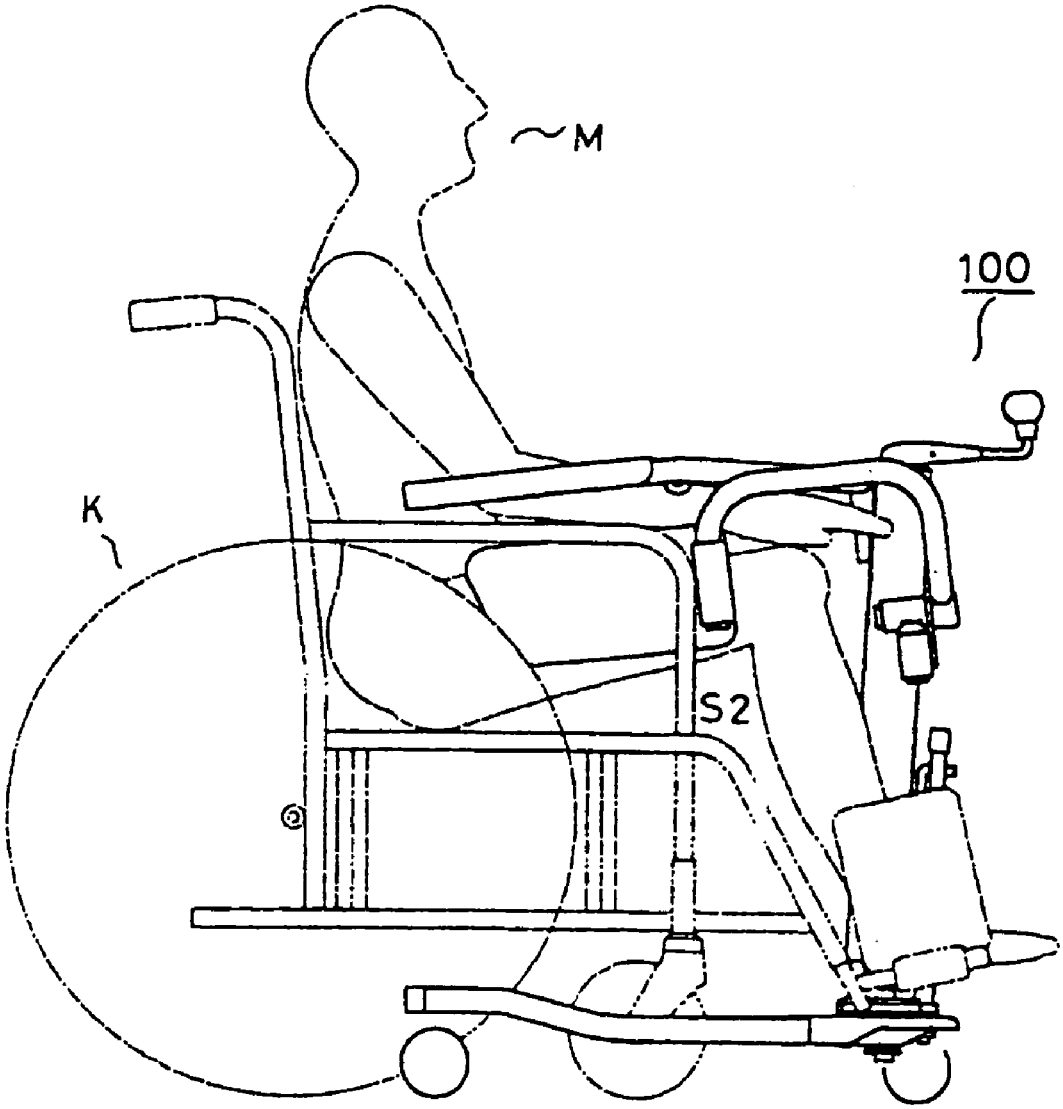
FIG. 34 is a side view showing the state shown in FIG. 33.
Figure 35:
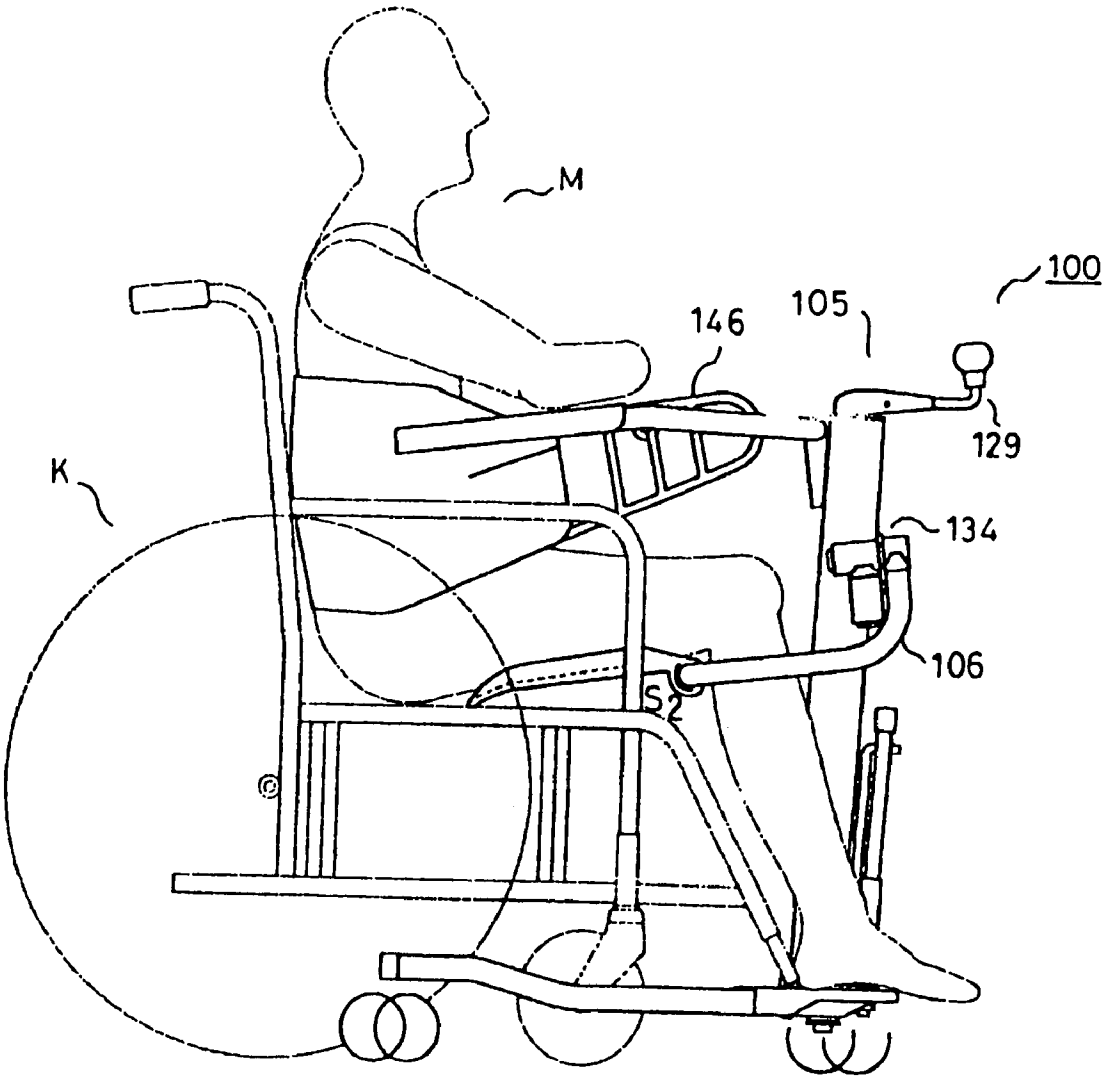
FIG. 35 is a side view exemplifying the thigh supports lowered adjacent to the sitting patient.

The thigh support 107 is arch-shaped to support the patient's thighs, and the bearing unit 107*a* is pivoted to the arm 106. As shown in FIG. 26, the bearing unit 107*a* is provided with a stopper 107*b* designed to come into contact with an engager 106*a* secured to the arm 106. The thigh support 107 is kept rotatable so long as the stopper 107*b* is engaged with the engager 106*a*. More specifically, it is kept rotatable from an angular position where the arms are easily inserted up to an angular position where the weight of the patient is dispersed when they support his or her thighs; in FIG. 18, from 0° to 25° in an anti-clockwise direction. As shown in FIG. 34, a triangular space S2 is formed between the backs of the patient's thighs and the thigh supports. The same space S2 is formed towards a side frame of a supportive chair (K), thereby allowing the use of the bearing unit 107*a* having a relatively large diameter.

A handrail 144 is provided above the thigh supports 107. It is secured to a frame 108 secured to the pillar 105, the frame 108 having an open end. Because of the open end whichever C-shape, U-shape or any other it takes. The handrail 108 is provided with an engager 145 in its middle portion. Owing to this engager 145 provided inside the handrail 108, a back upholstery 146 can be easily removed and attached.

Figure 27:
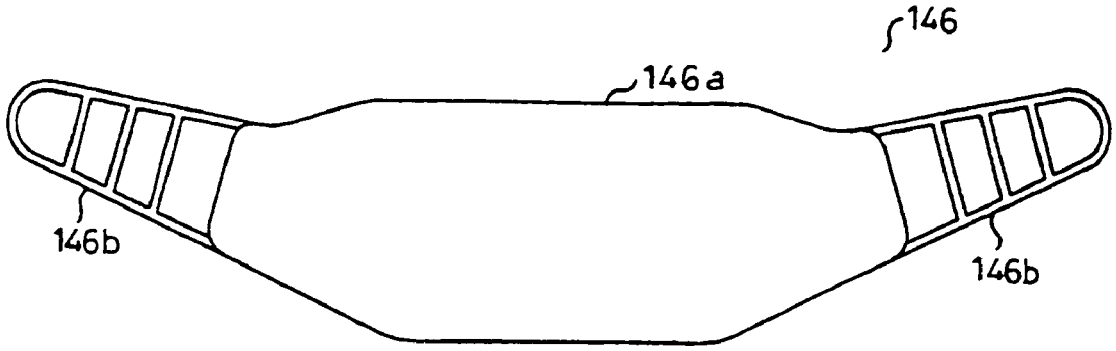
FIG. 27 is a front view showing the back upholstery of FIG. 26.
Figure 28:
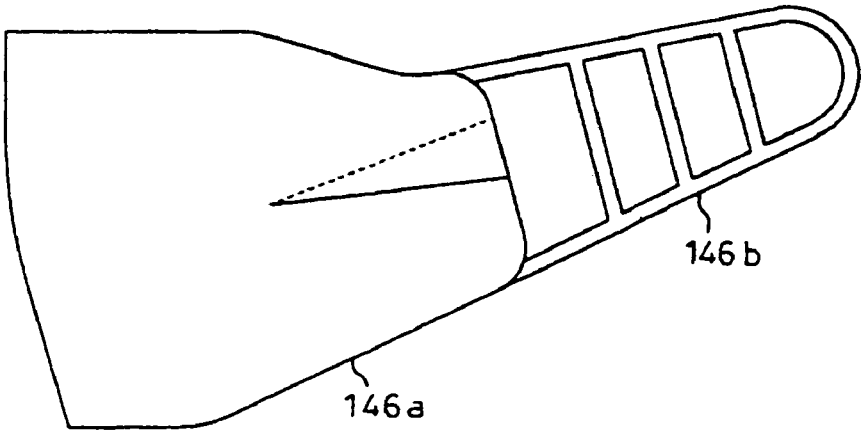
FIG. 28 is a side view showing a modified version of the back upholstery.
Figure 29:
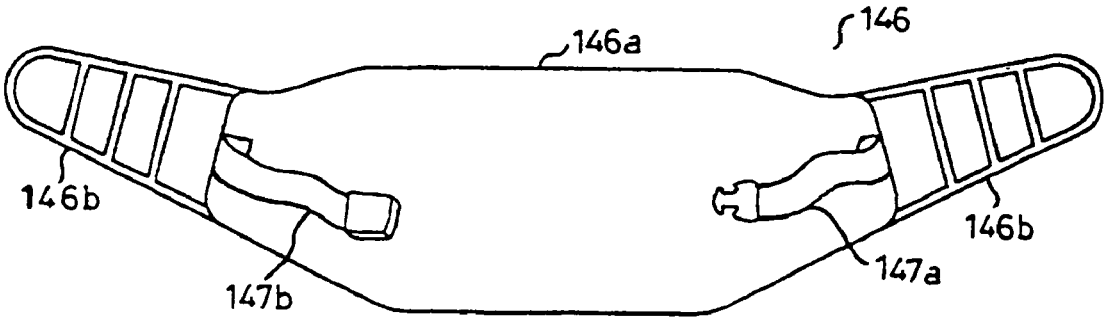
FIG. 29 is a front view showing the back upholstery of FIG. 28.
Figure 30:
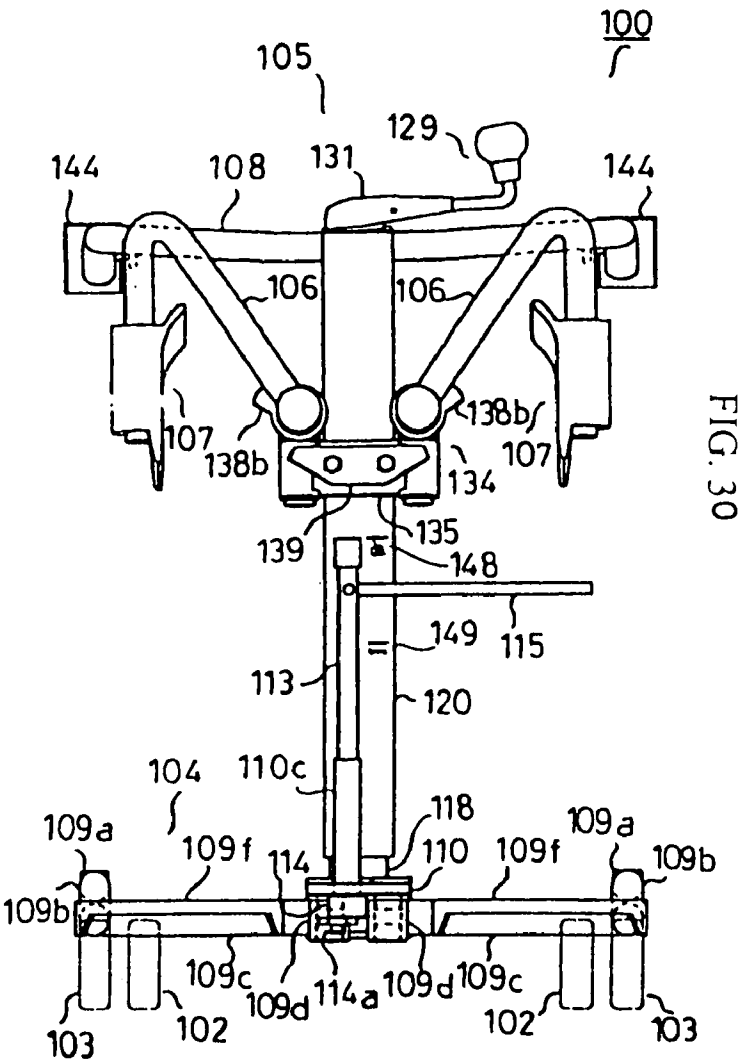
FIG. 30 is an entire front view showing the arms raised to their upper positions.
Figure 31:
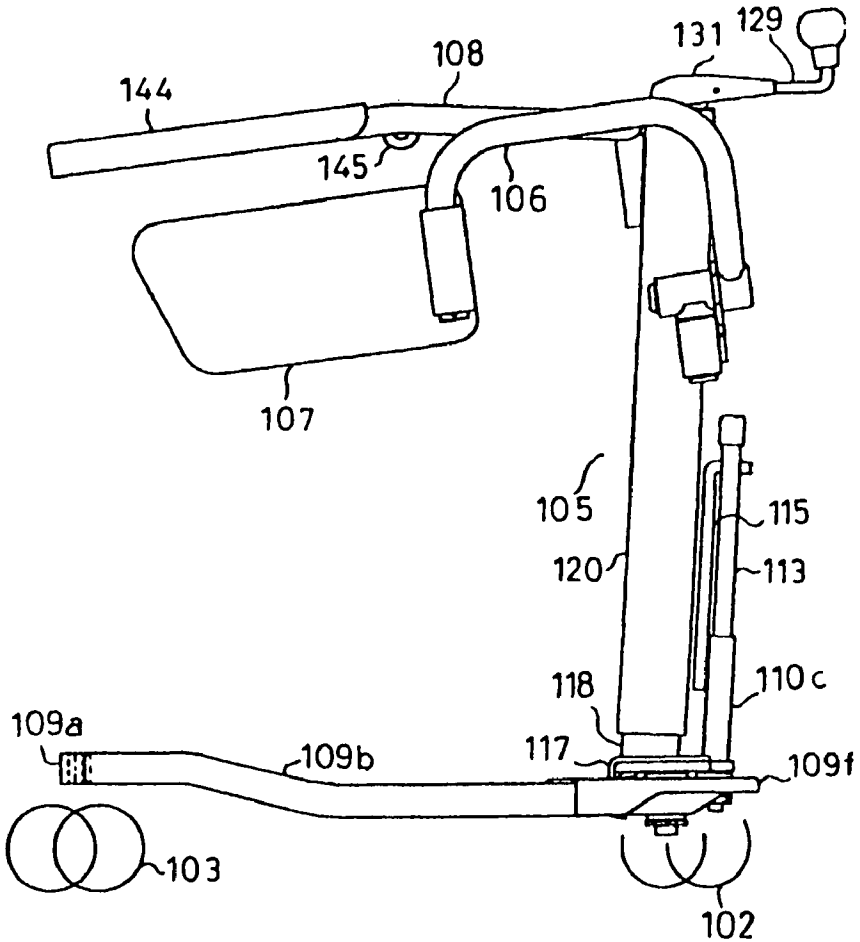
FIG. 31 is an entire side view showing the supportive device of FIG. 30.
Figure 32:
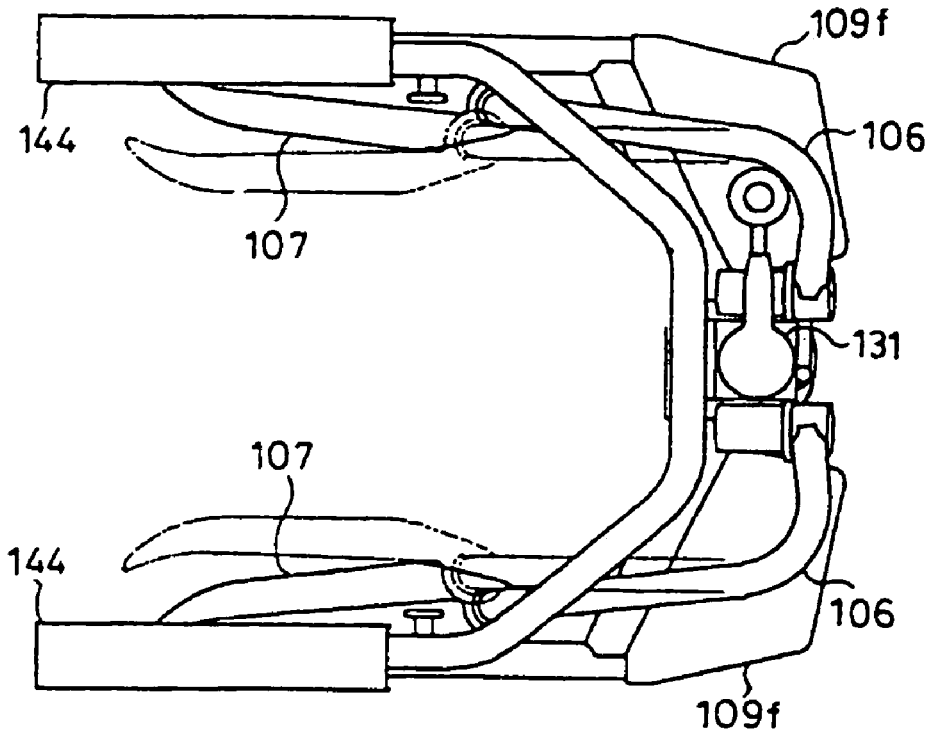
FIG. 32 is a plan view showing the supportive device of FIG. 30.
Figure 33:
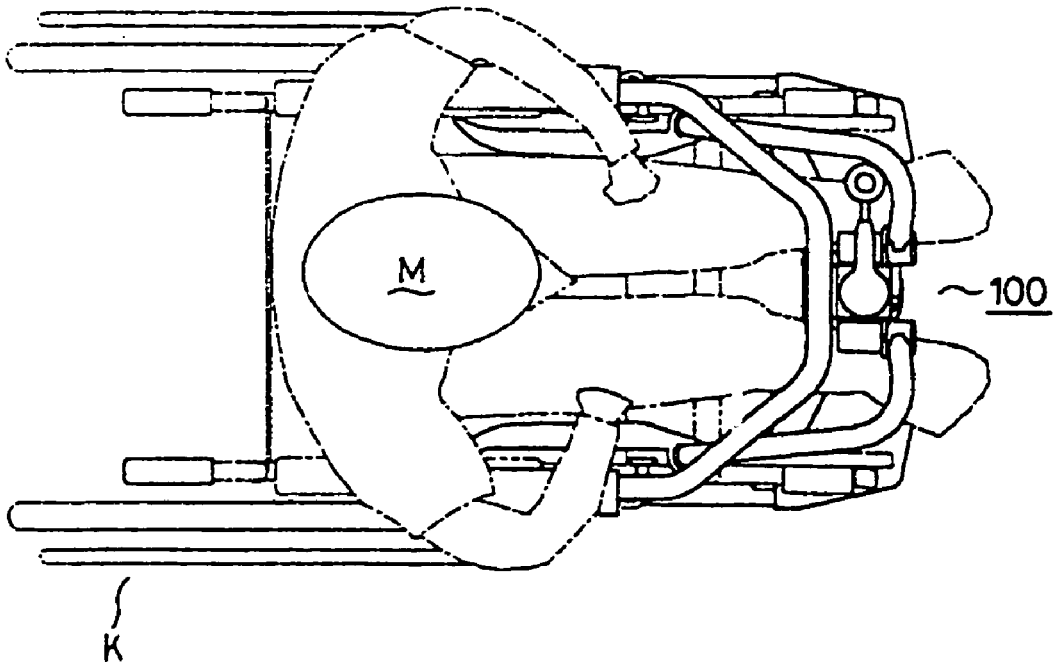
FIG. 33 is a plan view exemplifying a state in which the patient is shifted from a patient's supportive chair.

Referring to FIGS. 27 to 29, the back upholstery 146 is composed mainly of a back section 146*a* and engaging sections 146*b*, the former being made of a solid but flexible material, so that the upholstery can be inserted between the back of the supportive chair (K) and the patient (M)'s back while conforming to the contour of the patient's back, and the engaging sections 146*b* are engaged with the engagers 145. The engaging sections 146*b* can be provided with several engaging spots shaped as shown in FIGS. 27 to 29. Preferably, as shown in FIG. 28, the back upholstery is provided with a slit in its back section 146*a*, so that the back section 146*a* can have such a curved portion due to the slips as to conform to the contour of the patient's back.

In FIG. 29, the back upholstery 146 can be provided with a pair of belts 147*a* and 147*b*, one being at one end and the other at the other end, which are extended around the patient's waist until they meet each other at the front of the patient's body. In this way the back upholstery is kept in tight contact with the patient's back.

The pillar 105 slides up and down in accordance with the vertical movement of the thigh supports 107. The sliding framework 120 can be provided with a mark 148 at a point where the thigh supports 107 and the seat of the patient's supportive chair (K), and a mark 149 where the heights of the bed and the thigh supports 107 are equal. These marks are helpful in adjusting the height of the thigh supports 107 when the arms 106 are raised.

Referring to FIGS. 30 to 35, the operation of the supportive device 100 will be described:

The arms 106 are rotated outward to open rearward. At this stage, the arms are automatically locked by the automatic locking device 140, thereby relieving the patient of a manual toil of holding the arms 106. In addition, the automatic locking device eliminates the necessity of releasing the lever or the like. This facilitates the shifting of the patient from and to the supportive device 100 and to and from the bed.

Then, the lever 129 is operated to ensure that the thigh supports 107 rises high enough to be equal to the height of the patient (M)'s thighs. In this case, either the marks 148 or 1149 can be used as a visual standard, thereby ensuring that the heights of the thigh supports 107 and the bed are matched.

If the supportive chair (K) is wider than the space S1, the lever 115 is operated to widen the supporting frame 109. As shown in FIG. 34, the supportive chair is inserted into the depth of the back of the patient's knees where the bearing unit 107*a* of the thigh supports 107 are present. The thigh supports 107 can be separated or approached, thereby allowing the chair to advance into between the patient (M)'s thighs and the side of the chair (K).

After the thigh supports have been inserted, the arms 106 are rotated downward. The automatic locking devices 106 are automatically released. Owing to the presence of space S2, the bearing units 107*a* of the thigh supports 107 are readily inserted without conflicting with the patient's knees or the supportive chair (K).

After the patient's thighs stay on the thigh supports 107, the back upholstery 146 is inserted between the back of the supportive chair and the patient's back. Because of the solidity and resiliency of the back upholstery 146, it can be easily inserted along the patient's back. Then, the engaging sections 146*b* are engaged with the mating engagers 145, wherein the patient's waist can be adequately tightened by selecting an appropriate engaging position in accordance with his or her size. The back upholstery conforms to the contour of the patient's back. The belts 147*a* and 147*b* prevent the back upholstery from slipping off.

Then, the lever 129 is rotated to raise the thigh supports 107, which will incline at a predetermined angle, thereby avoiding the local application of the patient's weight to the thigh supports. Thus the thigh supports 107 evenly support the patient's thighs. By further raising the thigh supports, the patient (M) is made ready to shift from the supportive chair to the supportive device 100. In addition, the patient is shifted onto a bed, wherein the reverse procedure follows.

The patient can use a toilet while staying in the supportive device owing to the open structure of the supportive device 1 below the patient's buttocks.

The supportive device of the invention includes the space S2 formed between the patient's thighs and the supportive chair, adapted for insertion of the thigh supports 107, wherein the thigh supports support the patient's thighs, and the back upholstery supports the patient's back. As a result, the patient M is allowed to shift from the supportive chair to the supportive device while taking his or her normal sitting posture. This relieves the patient of an unstable feeling as if he or she is suspended.

Since the space interval between the thigh supports 107, and the position of the back upholstery can be variously adjusted in accordance with the patient's size. The supportive device is so compact in size and easy to operate that the aged people and women can easily help the patient shift from one structure such as a bed to the supportive device, and vice versa.

INDUSTRIAL APPLICABILITY

The supportive device of the present invention requires no special skill to use, and is simple in structure which includes a pair of front wheels and a pair of rear wheels, a framework having an open end, a pillar erected on the framework, a pair of arms provided in the pillar, a pair of thigh supports provided in the arms, a handrail framework secured to the pillar, the handrail framework having an open end, a back upholstery placed behind the thigh supports, and a lifting device. As a result, the supportive device can be mass produced, and used widely not only in hospitals but also in private use in homes.

What is claimed is:

1. A supportive device for facilitating movement between one structure such as a bed and another, such as a supportive chair, comprising a chassis (4) having an open rear end, provided with a pair of front wheels (2) and a pair of rear wheels (3), a pillar (14) erected on the chassis (4), a pair of arms (31) provided in the pillar (14), a pair of thigh supports (32) provided in the arms (31), a handrail (46) whose rear end is open, a back upholstery (48) rotatable away from the thigh supports (32), and a lifting device for raising and lowering the thigh supports (32), wherein the arms (31) are rotated in accordance with the rotation of shafts (36), in the course of the rotation of the arms (31) the thigh supports (32) being moved downward.

2. The supportive device according to claim 1, wherein the thigh supports (32) are capable of inclining.

3. The supportive device according to claim 1 or 2, further comprising a displacing device provided in the arms (31) whereby a spacing between the thigh supports (32) can be modified.

4. The supportive device according to claim 3, wherein the displacing device comprises a pair of brackets (34) provided in the pillar (14), a double bearing unit in which a first bearing (40) having an axial hole and a second bearing (41) having a traverse hole are intersected, a shaft (42) carried in the second bearing (41), a shaft (36) carried in the first bearing (40), the shaft (42) being secured to at least one of the arms (31), wherein a space S3 is produced at a point where the shafts are mutually intersected, the arms (31) being rotatable from an upper position to a lower position, and when the arms (31) are raised upward, the respective thigh supports (32) are horizontally rotated so as to space one from the other at an adequate interval.

5. The supportive device according to claim 1, further comprising a bag containing air or gas or liquid placed behind the thigh supports (32), the bag being elastically expanded behind the thigh supports when the lowering thigh supports (32) come into contact with a target structure such as a bed.

* * * * *